US007911406B2

(12) United States Patent
Eckwielen et al.

(10) Patent No.: US 7,911,406 B2
(45) **Date of Patent: *Mar. 22, 2011**

(54) MODULAR DIGITAL UHF/VHF ANTENNA

(75) Inventors: Bradley Lee Eckwielen, Oostburg, WI (US); David LeRoy Hagen, Goshen, IN (US)

(73) Assignee: Bradley Lee Eckwielen, Oostburg, WI (US)

( * ) Notice: Subject to any disclaimer, the term of this patent is extended or adjusted under 35 U.S.C. 154(b) by 566 days.

This patent is subject to a terminal disclaimer.

(21) Appl. No.: 11/731,132

(22) Filed: Mar. 31, 2007

(65) Prior Publication Data

US 2007/0262912 A1 Nov. 15, 2007
US 2008/0309573 A9 Dec. 18, 2008

Related U.S. Application Data

(60) Provisional application No. 60/787,981, filed on Mar. 31, 2006.

(51) Int. Cl.
*H01Q 19/00* (2006.01)

(52) U.S. Cl. ..... 343/833

(58) Field of Classification Search ..... 343/725, 343/811, 727, 893, 797, 853, 833, 75
See application file for complete search history.

(56) References Cited

U.S. PATENT DOCUMENTS 2,270,314 A 1/1942 Kraus
2,430,353 A 2/1945 Masters
2,551,586 A 8/1945 Dobler et al.
2,615,005 A 9/1950 White
2,714,659 A 7/1951 Johnson et al.
2,691,730 A 3/1954 Lo
RE23,960 E 3/1955 Lorusso
2,941,206 A 4/1956 Finneburgh, Jr.
2,975,423 A 3/1958 Wells
2,888,678 A 7/1958 Weiss et al.
2,897,496 A 7/1959 Woodward, Jr.
3,167,775 A 1/1965 Guertler
3,344,431 A 9/1967 Greenberg et al.
3,362,026 A 1/1968 Smith, Jr. et al.
3,440,658 A 4/1969 Bogner
3,475,759 A 10/1969 Winegard
3,482,250 A 12/1969 Maner
3,503,074 A 3/1970 Carter
3,518,693 A 6/1970 Winegard et al.
3,534,369 A 10/1970 Rea
3,550,144 A 12/1970 Barbano et al.
3,573,841 A 4/1971 Greenberg (Continued)

OTHER PUBLICATIONS

Anon. Model HD-7080P Platinum Series High Definition VHF/UHF Antenna, Winegard Company, 3000 Kirkwood St., Burlington IA 52601-2000 Rev. Apr. 2002, Downloaded from http://www.winegard.com/offair/pdf/HD7080P.pdf.

(Continued)

*Primary Examiner* — Huedung Mancuso

(57) ABSTRACT

The invention relates to Radio Frequency (RF) antennas suitable for receiving and/or transmitting digital signals in the Ultra High Frequency (UHF) and/or Very High Frequency (VHF) ranges. The invention comprises a modular driven DUV antenna comprising a driven DUV element, an RF signal line RF communicatively connected to the driven DUV element, and an antenna mount supporting the DUV element; and a modular RF signal enhancer, supported by the antenna mount and selected from: an RF amplifier and a passive RF enhancer positioned to enhance the RF performance of the DUV antenna and comprising one of: an RF director, an RF reflector, and an RF booster.

39 Claims, 8 Drawing Sheets

U.S. PATENT DOCUMENTS

| | | | | |
|---|---|---|---|---|
| 3,576,580 | A | 4/1971 | Enyedy et al. | |
| 3,599,217 | A | 8/1971 | Grant | |
| 3,618,103 | A | 11/1971 | Ringland | |
| 3,653,056 | A | 3/1972 | Peterson | |
| 3,710,337 | A | 1/1973 | Grant | |
| 3,727,232 | A | 4/1973 | Grant | |
| 3,931,626 | A | 1/1976 | Simons | |
| 3,982,248 | A | 9/1976 | Archer | |
| 3,984,841 | A | 10/1976 | Mikulich, Jr. et al. | |
| 4,010,473 | A | 3/1977 | DiMeo | |
| 4,114,163 | A | 9/1978 | Browick | |
| 4,145,696 | A | 3/1979 | Gueguen | |
| 4,160,980 | A | 7/1979 | Murray | |
| 4,251,818 | A | 2/1981 | Lauder | |
| 4,290,071 | A | 9/1981 | Fenwick | |
| 4,293,861 | A | 10/1981 | Winegard | |
| 4,308,540 | A | 12/1981 | Winegard et al. | |
| 4,398,201 | A | 8/1983 | Winegard et al. | |
| 4,518,968 | A | 5/1985 | Hately | |
| 4,604,628 | A | 8/1986 | Cox | |
| 4,667,204 | A | 5/1987 | Hedrick | |
| 4,812,855 | A | 3/1989 | Coe | |
| 5,497,166 | A * | 3/1996 | Mahnad | 343/795 |
| 5,612,706 | A | 3/1997 | Podell | |
| 5,666,126 | A | 9/1997 | Lange | |
| 5,841,406 | A | 11/1998 | Smith | |
| 5,898,410 | A | 4/1999 | DeMarre | |
| 6,133,889 | A | 10/2000 | Yarsunas et al. | |
| 6,154,180 | A | 11/2000 | Padrick | |
| 6,181,292 | B1 * | 1/2001 | Dobrovolny | 343/819 |
| 6,677,914 | B2 | 5/2002 | Mertel | |
| 6,498,589 | B1 | 12/2002 | Horii | |
| 6,774,863 | B2 | 2/2003 | Shirosaka et al. | |
| 6,621,463 | B1 | 9/2003 | Lam | |
| D480,387 | S | 10/2003 | Burns | |
| 6,650,300 | B2 * | 11/2003 | Skalina et al. | 343/791 |
| 6,842,141 | B2 | 1/2005 | Suh et al. | |
| 6,859,182 | B2 | 2/2005 | Horii | |
| 6,859,189 | B1 | 2/2005 | Ramirez et al. | |
| 6,922,179 | B2 | 7/2005 | McCollum | |
| 6,930,649 | B1 | 8/2005 | Sergi | |
| 6,977,624 | B1 | 12/2005 | Szente | |
| 7,015,868 | B2 | 3/2006 | Puente Ballarde et al. | |
| 7,071,891 | B2 | 7/2006 | Shirosaka et al. | |
| 7,205,953 | B2 | 4/2007 | Knadle, Jr. et al. | |
| 7,205,955 | B2 | 4/2007 | Shirosaka et al. | |
| 7,215,294 | B2 | 5/2007 | Jocher | |
| 7,292,199 | B2 | 11/2007 | Horii | |
| 7,586,453 | B2 * | 9/2009 | Apostolos | 343/715 |
| 7,609,215 | B2 * | 10/2009 | Apostolos | 343/711 |
| 2007/0063909 | A1 * | 3/2007 | Fujita et al. | 343/795 |
| 2008/0018550 | A1 | 1/2008 | Horii | |

OTHER PUBLICATIONS

Anon. Model HD-7010 VHF/UHF/FM Antenna, Kirkwood St., Burlington IA 52601-2000 Rev. Jun. 2001, Downloaded from http://www.winegard.com/offair/pdf/HD-7010.pdf.

Anon. Model HD-7015 VHF/UHF/FM Antenna, Winegard Company, 3000 Kirkwood St., Burlington IA 52601-2000 Rev. Jun. 2001, Downloaded from http://www.winegard.com/offair/pdf/HD-7015.pdf.

Anon. Model HD-7082P Platinum Series High Definition VHF/UHF Antenna, Winegard Company, 3000 Kirkwood St., Burlington IA 52601-2000 Rev. Apr. 2002, Downloaded from http://www.winegard.com/offair/pdf/HD7082P.pdf.

Anon. Models SS-1000 & SS-2000 HDTV SquareShooter Antenna System, Winegard Company, 3000 Kirkwood St., Burlington IA 52601 Rev. Jul. 2005, Downloaded from http://www.winegard.com/offair/pdf/WC-811.pdf.

Anon. Model HD-5030 HD Series VHF/FM Antenna, Winegard Company, 3000 Kirkwood St., Burlington IA 52601-2000 Rev. Jun. 2001, Downloaded from http://www.winegard.com/offair/pdf/HD-5030.pdf.

Anon. Model YA-1713 Broadband YAGI Antenna, Winegard Company, 3000 Kirkwood St., Burlington IA 52601-2000 Downloaded from http://www.winegard.com/offair/pdf/Ya-1713.pdf.

Anon. Model YA-6260 Broadband YAGI Antenna, Winegard Company, 3000 Kirkwood St., Burlington IA 52601-2000 Rev. Jun. 2001 Downloaded from http://www.winegard.com/offair/pdf/Ya-6260.pdf.

Anon. Model HD-9095P, High Definition UHF Antenna, Winegard Company, 3000 Kirkwood St., Burlington IA 52601-2000 Rev. Feb. 2002, Downloaded from http://www.winegard.com/offair/pdf/HD99095P.pdf.

Anon.Winegard High Definition (HD) Platinum Antennas, Instructions, VHF/UHF Models HD9065, HD9085P, HD9095P. Winegard Company, 3000 Kirkwood St., Burlington IA 52601-2000 Rev. Jan. 2002, Downloaded from http://winegard.com/offair/pdf/1450173.pdf.

Anon. Model HD7084P, High Definition VHF/UHF Antenna, Winegard Company, 3000 Kirkwood St., Burlington IA 52601-2000 Rev. Apr. 2002, Downloaded from http://www.winegard.com/offair/pdf/HD7084P.pdf.

Anon. Model HD-9075P, High Definiton UHF Antenna, Winegard Company, 3000 Kirkwood St., Burlington IA 52601-2000 Rev. Feb. 2002, Downloaded from http://www.winegard.com/offair/pdf/HD99075P.pdf.

Anon. Model HD-9032, High Definition UHF Antenna, Winegard Company, 3000 Kirkwood St., Burlington IA 52601-2000 Rev. Jun. 2001, Downloaded from http://www.winegard.com/offair/pdf/HD9032.pdf.

Anon. Model HD 9022, HD Series UHF Antenna, Winegard Company, 3000 Kirkwood St., Burlington IA 52601-2000 Rev. Jun. 2001, Downloaded from http://www.winegard.com/offair/pdf/HD9022.pdf.

Anon. Model HD4400 , HD Series UHF Antenna, Winegard Company, 3000 Kirkwood St., Burlington IA 52601-2000 Downloaded from http://www.winegard.com/offair/pdf/HD4400.pdf.

Anon. Model HD8800 , HD Series UHF Antenna, Winegard Company, 3000 Kirkwood St., Burlington IA 52601-2000 Downloaded from http://www.winegard.com/offair/pdf/HD8800.pdf.

Anon. Model HD6055P , Platinum Series High Definition FM Antenna, Winegard Company, 3000 Kirkwood St., Burlington IA 52601-2000 Rev. Jun. 2002. Downloaded from http://www.winegard.com/offair/pdf/HD6055P.pdf.

Anon. Model HD6010 , HD FM Antenna, Winegard Company, 3000 Kirkwood St., Burlington IA 52601-2000 Downloaded from http://www.winegard.com/offair/pdf/HD6010.pdf.

Anon. Model HD6000 , HD FM Antenna, Winegard Company, 3000 Kirkwood St., Burlington IA 52601-2000 Rev. Jun. 2001 Downloaded from http://www.winegard.com/offair/pdf/HD6000.pdf.

Anon. Model SS-3000, Indoor HDTV Antenna, Winegard Company, 3000 Kirkwood St., Burlington IA 52601 (c) 2006 Winegard Co. Downloaded from http://www.winegard.com/offair/pdf/SS-3000.htm.

Anon. Model GS-1100 non-amplified & GS-2000 amplified, Sensar III, Bi-directional antenna for UHF/VHF reception, Winegard Company, 3000 Kirkwood St., Burlington IA 52601, S:\engspec\gs-2200 Downloaded from http://winegard.com/offair/pdf/GS-2200.pdf.

HDP-269 Preamp, Winegard Company, 3000 Kirkwood St., Burlington IA 52601-2000 2004-2006, Downloaded from: http://www.winegard.com/offair/pdf/WC-809%20%20HDP-269.pdf.

Anon. Model 5885 ColorKing VHF/UHF/FM Antenna Antennacraft Specification Sheet, ANTENNACRAFT, P.O. Box 1005, Burlington, IA 52601, Dec. 2001, Downloaded from: http://www.antennacraft.net/pdfs/5885.pdf.

Anon. Model 5884 ColorKing VHF/UHF/FM Antenna, Antennacraft Specification Sheet, ANTENNACRAFT, P.O. Box 1005, Burlington, IA 52601, Dec. 2001, Downloaded from: http://www.antennacraft.net/pdfs/5884.pdf.

Anon. Model HDX1000 HDTV UHF/VHF Antenna, Engineering Specification Sheet, ANTENNACRAFT, P.O. Box 1005, Burlington, IA 52601, Dec. 2001, Downloaded from: http://www.antennacraft.net/pdfs/HDX1000.pdf.

Anon. Model No. U-8000, Engineering Specifications, ANTENNACRAFT, P.O. Box 1005, Burlington, IA 52601, U-8000xls, Rev. Aug. 1, 2007, Downloaded from: http://www.antennacraft.net/pdfs/U8000.pdf.

Anon. Model No. U-4000, Engineering Specifications, ANTENNACRAFT, P.O. Box 1005, Burlington, IA 52601, U-4000.xls Rev. Aug. 1, 2007, Downloaded from: http://www.antennacraft.net/pdfs/U4000.pdf.

Anon. Model CCS1843 VHF/UHF/FM Antenna, Engineering Specifications, ANTENNACRAFT, P.O. Box 1005, Burlington, IA 52601, Dec. 2001, Downloaded from: http://www.antennacraft.net/pdfs/CCS1843.pdf.

Anon. Model CCS1233 VHF/UHF/FM Antenna, Engineering Specifications, ANTENNACRAFT, P.O. Box 1005, Burlington, IA 52601, Dec. 2001, Downloaded from: http://www.antennacraft.net/pdfs/CCS1233.pdf.

Anon. Model C480 VHF/UHF/FM Antenna, Engineering Specifications, ANTENNACRAFT, P.O. Box 1005, Burlington, IA 52601, Dec. 2001, Downloaded from: http://www.antennacraft.net/pdfs/C480.pdf.

Anon. Model HD1850 Heavy-Duty, High Definition VHF/UHF/FM Antenna, Engineering Specifications, ANTENNACRAFT, P.O. Box 1005, Burlington, IA 52601, May 2003, Downloaded from: http://www.antennacraft.net/pdfs/HD1850.pdf.

Anon. Model HD1800 Heavy-Duty, High Definition VHF/UHF/FM Antenna, Engineering Specifications, ANTENNACRAFT, P.O. Box 1005, Burlington, IA 52601, May 2003, Downloaded from: http://www.antennacraft.net/pdfs/HD1800.pdf.

Anon. Model HD1200 Heavy-Duty, High Definition VHF/UHF/FM Antenna, Engineering Specifications, ANTENNACRAFT, P.O. Box 1005, Burlington, IA 52601, May 2003, Downloaded from: http://www.antennacraft.net/pdfs/HD1200.pdf.

Anon. Model HD850 Heavy-Duty, High Definition VHF/UHF/FM Antenna, Engineering Specifications, ANTENNACRAFT, P.O. Box 1005, Burlington, IA 52601, May 2003, Downloaded from: http://www.antennacraft.net/pdfs/HD850.pdf.

Anon. Model AC9 VHF/UHF/FM, Engineering Specifications, ANTENNACRAFT, P.O. Box 1005, Burlington, IA 52601, Dec. 2001, Downloaded from: http://www.antennacraft.net/pdfs/AC9.pdf.

Anon. Model 4BG26 Permacolor UHF/VHF/FM, Engineering Specifications, ANTENNACRAFT, P.O. Box 1005, Burlington, IA 52601, Dec. 2001, Downloaded from: http://www.antennacraft.net/pdfs/4BG26.pdf.

Anon, Model CCS822 VHF/UHF/FM Antenna, Engineering Specifications, ANTENNACRAFT, P.O. Box 1005, Burlington, IA 52601, Dec. 2001, Downloaded from: http://www.antennacraft.net/pdfs/CCS822.pdf.

Anon. Model CS1100 VHF/FM Antenna, Engineering Specifications, ANTENNACRAFT, P.O. Box 1005, Burlington, IA 52601, Dec. 2001, Downloaded from: http://www.antennacraft.net/pdfs/CS1100.pdf.

Anon. Model CS600 VHF/FM Antenna, Engineering Specifications, ANTENNACRAFT, P.O. Box 1005, Burlington, IA 52601, Dec. 2001, Downloaded from: http://www.antennacraft.net/pdfs/CS600.pdf.

Anon. Model MXU47 UHF Antenna, Engineering Specifications, ANTENNACRAFT, P.O. Box 1005, Burlington, IA 52601, Dec. 2001, Downloaded from: http://www.antennacraft.net/pdfs/MXU47.pdf.

Anon. Model MXU59 UHF Antenna, Engineering Specifications, ANTENNACRAFT, P.O. Box 1005, Burlington, IA 52601, Dec. 2001, Downloaded from: http://www.antennacraft.net/pdfs/MXU59.pdf.

Anon, Model HBU22 Hi-Band VHF and UHF Antenna, Engineering Specifications, ANTENNACRAFT, P.O. Box 1005, Burlington, IA 52601, Dec. 2001, Downloaded from: http://www.antennacraft.net/pdfs/MXU59.pdf.

Anon, HBU22 Manual, ANTENNACRAFT, P.O. Box 1005, Burlington, IA 52601, 7ALLCHANIS 507, www.antennacraft.net Downloaded from: http://www.antennacraft.net/Manuals/Generic-VHF-UHF.pdf.

Get the Clearest Picture, Channel Master, Reception and Connectivity Consumer & Professional Products, Antennas Special Market, pp. 1-16, (c) 2006 Channel Master, a division of PCT International Inc. Pub PCTCM001.200611 Downloaded from http://www.channelmasterintl.com/pdfs/CHANNEL%20MASTER%20BY%20PCT%20CATALOG_20070410.pdf.

Richard C. Johnson, Antenna Engineering Handbook, 3rd Edition, ISBN 0-07-032381-X, Chapter 28, Raymond H. Duhamel & Ali R. Mahnad, TV & FM Transmitting Antennas; Chapter 29 Edward B. Joy, TV Receiving Antennas.

John D. Kraus et al., Antennas for All Applications, 3rd Edition, 2006, McGraw-Hill SIBN 0-07-060185-2, pp. 425-464.

Ken Nist, KQ6QV, Comparing some commercially available antennas. HDTVprimer, HDTV Magazine, Feb. 2, 2006. Downloaded from: http://www.hdtvprimer.com/ANTENNAS/comparing.html.

Ken Nist, Comparing some commercially available antennas, Appendices. HDTVprimer, HDTV Magazine, Feb. 2, 2006. Downloaded from: http://www.hdtvprimer.com/ANTENNAS/. Including, The Channel Master 4228 8-Bay; The Channel Master 4221 4-Bay; The Channel Master 4248; The Televes DAT-75; The Winegard PR-8800 8-Bay;: The Winegard PR-4400 4-Bay; The Channel Master 4242 VHF/UHF combo; The Channel Master 3018; Small indoor loops; The Double Bowtie; The DB-2 from AntennasDirect.com; The Winegard Square Shooter; The Winegard.

Doug Lung, Antennas for DTV reception, Mar. 6, 2002, TV Technology.com, Downloaded from: http://www.tvtechnology.com/features/On-RF/antennas.shtml.

R. Dean Straw, N6BV, The ARRL Antenna Book, 20th Edition, (c)2003-2005 The AARL, Inc,, Newington CN, ISBN 0-87259-904-3, The Corner Reflector, pp. 18-14 to 18-17.

* cited by examiner

MODULAR DIGITAL UHF/VHF ANTENNA

This application incorporates by reference the Non-Provisional application Ser. No. 11/731,099 "Digital UHF VHF Antenna" filed on 31 Mar. 2007 and issued as U.S. Pat. No. 7,626,557 issued on Dec. 1, 2009. This application claims the priority benefit under 35 U.S.C. sctn. 119(e) of Provisional Application No. 60/787,981 "Digital UHF VHF Antenna" filed on Mar. 31, 2006, and of Provisional Application "Modular Digital UHF/VHF Antenna" cofiled on Mar. 31, 2006 via US Express Mail # EB 190327063 US.

BACKGROUND OF THE INVENTION

1. Field of Invention

This invention relates to Radio Frequency (RF) antennas suitable for receiving and/or transmitting digital signals in the Ultra High Frequency (UHF) and/or Very High Frequency (VHF) ranges.

2. Description of the Related Art

The Digital Television (DTV) broadcast causes pixilation or loss of reception if the signal delivered by an antenna is near or below threshold performance. Over the air broadcast includes both VHF and UHF DTV band channels. Antennas available to provide good VHF reception are large, complex, and expensive. They usually have numerous RF phasing lines and RF contacts that are prone to corrosion, and fatigue, degrading their performance. Antennas are often folded and users or installers frequently forget to unfold them. Antennas advertised for "VHF UHF" reception are typically small with modest performance in the UHF and poor performance in the VHF bands. DTV signals vary from high in urban areas to low in deep fringe areas. Yet relevant art antennas do not have the flexibility to configure gains according to local needs. Typical antennas are not suitable for bidirectional internet use.

OBJECTS AND ADVANTAGES

Configure simple antennas to give excellent UHF and good VHF performance.

Reduce or eliminate contact losses, and corrosion and fatigue degradation.

Provide easy installation with simple instructions, reducing installation errors.

Configure broadband antennas for Digital TV UHF and/or VHF and FM bands.

Configure Urban to Mid Fringe antennas up to 80 km/50 miles from transmitters.

Provide a light weight simply constructed but highly durable antennas.

Provide compact unobtrusive antennas with good performance.

Reduce signal loss in transmitting/receiving RF signals.

Reduce degradation in RF signal to noise ratio.

Provide efficient transfer of RF signals between driven antennas and connectors.

SUMMARY OF THE INVENTION

The incorporated technology teaches Digital UHF/VHF antennas and methods of configuring them which provide major improvements in wideband UHF and VHF performance that are relatively small and lightweight. These are configurable for the VHF range from 30 MHz to 300 MHz, and the UHF from 300 MHz to 3 GHz. Larger stiffened driven antennas were used with resonance in both prescribed VHF ranges and prescribed UHF ranges in some configurations. E.g., one half or five eighths waveform resonance from 174 MHz to 220 MHz in the VHF High band with three halves waveform resonance in the UHF DTV band from 470 MHz to 698 MHz. In some configurations, these were complemented by passive RF enhancers including RF directors in front of the driven antenna, RF reflectors behind the driven antenna, and off axis RF booster reflectors. The passive RF enhancers improve RF performance without the complex phasing lines, contacts and related contact and performance degradation with time of the prior art.

The present invention forms modules of these components that can be readily combined to facilitate configuration of Digital UHF/VHF (DUV) antennas for Urban, Metro and Fringe regions. In some embodiments, four driven DUV antennas modules are configured for UHF, broadband UHF/VHF, VHF and extended configurations. These are complemented by passive (or parasitic) RF enhancer modules comprising RF directors, RF reflectors and/or off axis RF boosters. In some embodiments these are complemented by modular RF amplifiers as needed.

In some embodiments, the RF directors are preferably configured into three to five director modules with varying number of UHF and VHF director elements selectable for Urban to Fringe applications. RF Reflectors are similarly preferably configured into three modules with VHF and UHF reflectors to provide increasing performance. In further embodiments, off axis RF boosters are configured into three modules with differing number of RF booster reflectors for Urban, Metro and Fringe applications.

These various modules are preferably supported by modular antenna supports that facilitate configuring a wide range of combinations of the modules described above. In some embodiments, the antenna supports are configured as modules. These preferably include antenna housing/amplifier modules to mount the driven antennas and connect with RF signal lines. Some modules preferably include modular amplifiers to boost performance as needed. Modules preferably include multiple amplifiers diplexed together to better communicate with multiple locations and/or multiple signal frequencies. E.g., including specialized VHF and/or UHF channels. Satellite and/or internet antenna connections and related filters are preferably included in some modules.

Some housing/antenna modules preferably include a major length of cable with bonded connections to eliminate contact losses. Other modules preferably use fiber optic lines to further reduce signal loss and degradation. Driven antenna supports and RF contacts, amplifier contacts and signal line contacts are preferably enclosed with epoxy and/or potting to minimize fatigue and corrosion. Some antenna support module configurations preferably include single and dual axis antenna boom to mast mounts for exterior and interior installations. Signal provision modules may include passive splitters, active distributors, and signal multiplexers such as two way internet and DTV.

Such embodiments of DUV antenna modules provide great flexibility to configure DUV antennas for a wide range of applications from "Urban" sites near DTV transmitters, to "Metro" sites further away, to "Fringe" sites requiring major signal enhancement. Yet they require few or more preferably only one user RF connection. This gives major advantages in higher sustained antenna performance.

BRIEF DESCRIPTION OF THE DRAWINGS

Having thus summarized the general nature of the invention and some of its features and advantages, certain preferred embodiments and modifications thereof will become apparent to those skilled in the art from the detailed description herein having reference to the figures that follow, each having features and advantages in accordance with one embodiment of the invention, namely.

List of Drawings

LIST OF TABLES

Table 1 Antenna Front Gain in VHF Hi Band & DTV UHF

Table 2 Antenna VHF, UHF Gains, Gain/Mass and Wideband Comparisons

Table 3 Differences between DigiTenna and Relevant Art Antenna gains

Table 4 Front/Back Ratio of DigiTenna and Relevant Art Antennas

Table 5 DigiTenna versus Relevant Art Front/Back Ratio Comparisons

DETAILED DESCRIPTION

Figure 1:
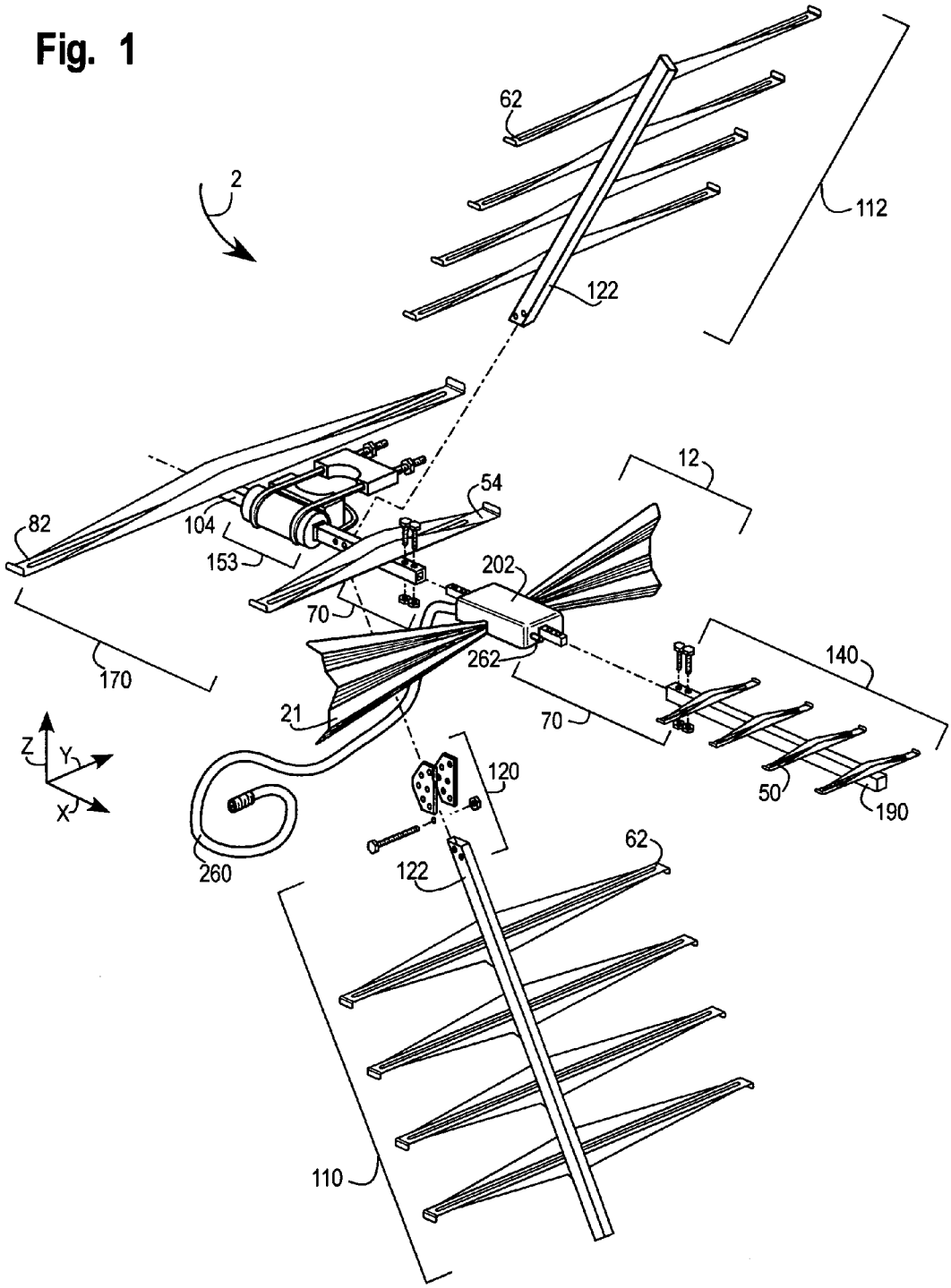
FIG. 1 Exploded view of a modular Digital UHV/VHF (DUV) antenna.

Modular UHF/VHF Antenna: With reference to FIG. 1, in one embodiment of the invention, a modular Digital UHF/VHF (DUV) antenna system 2 comprises a DUV antenna having a combination of a modular driven DUV antenna 12 and a modular RF enhancer to increase the signal gain of one or more received and/or transmitted digital signals in the Ultra High Frequency (UHF), Very High Frequency (VHF), and/or Radio Frequency (RF) ranges. The RF enhancer modules comprise one or more of an RF director 140, an RF reflector 170, an RF booster 112, and/or a DUV amplifier module 202. At least one of these RF enhancer modules are preferably selected from a selection of discrete enhancer modules.

The DUV antenna system further comprises a modular supporting structure or antenna mount 100 and an RF signal cable 260. These modules and components beneficially facilitate antenna configuration, assembly and shipment. The DUV dipole is preferably configured for broadband reception or transmission in one or more of digital UHF and/or VHF signals, preferably in the range from about 55 MHz to 801 MHz. E.g., comprising digital TV, digital Radio, and/or internet communications.

DUV Antenna: With reference to FIG. 1, in one embodiment of the invention, a DUV antenna 2 comprises a driven DUV antenna 12 comprising DUV element 21 configured to be driven by a Digital UHF/VHF (DUV) signal preferably with a frequency within one of the UHF range of 300 MHz to 3 GHz, the VHF range of 30 MHz to 300 MHz, or the collective Radio Frequency (RF) range of 30 MHz to 3 GHz. E.g., the DUV element 21 is preferably configured to be driven by a digital television signal (DTV), a digital FM signal or an internet signal. The DUV element 21 is RF communicatively connected to a RF feed or signal line 260.

Figure 2A:
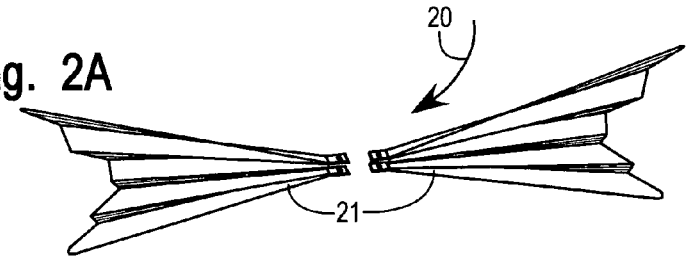
FIG. 2A DUV dipole in perspective.

Modular DUV Dipole: Referring to FIG. 1 and FIG. 2*a*, the driven DUV antenna 12 preferably comprises two DUV elements 21 collectively forming a DUV dipole 20 preferably configured for broadband reception over prescribed UHF and/or VHF ranges as described in the incorporated DUV antenna application. Referring to FIG. 15, and FIG. 17 in the incorporated DUV antenna application, DUV dipole 20 is preferably selected from one of a broadband M-DUV dipole 24, a UHF enhanced U-DUV dipole 22, a VHF enhanced V-DUV dipole 26, and an eXtended X-DUV dipole 28.

Figure 2B:
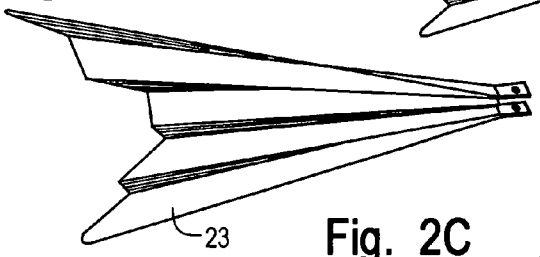
FIG. 2B U-DUV dipole element in perspective.
Figure 2C:
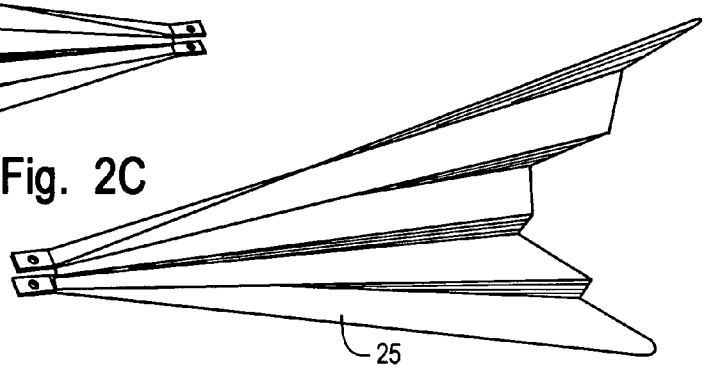
FIG. 2C M-DUV dipole element in perspective.
Figure 2D:
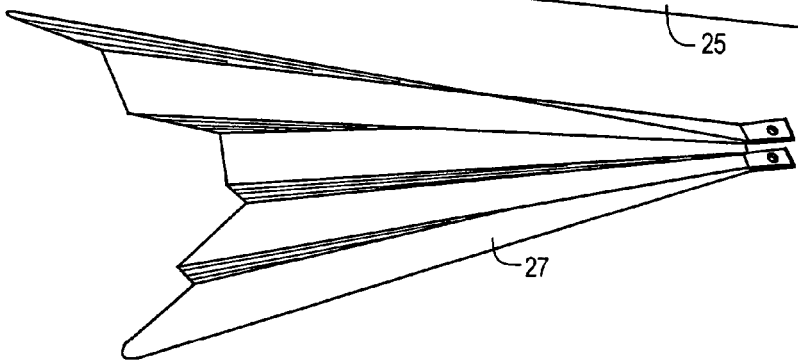
FIG. 2D V-DUV dipole element in perspective.
Figure 2E:
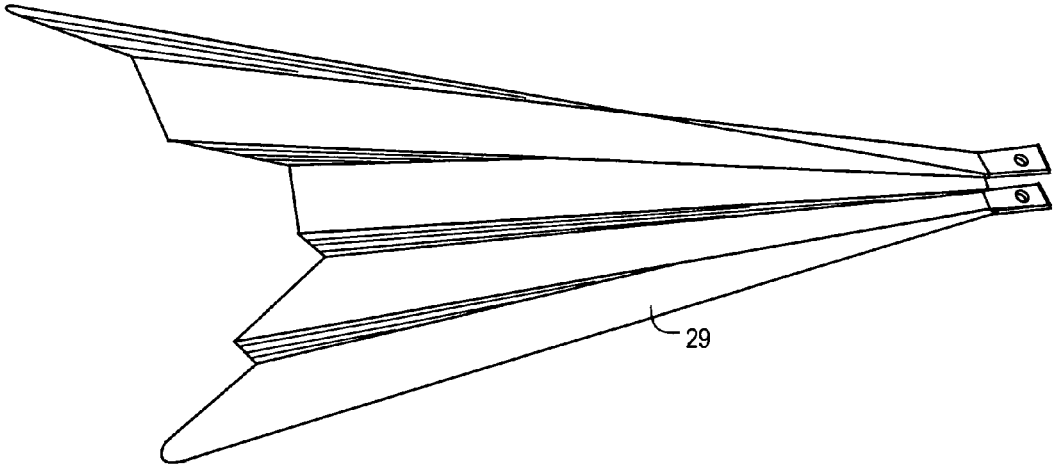
FIG. 2E X-DUV dipole element in perspective.

For example, in some configurations, the DUV elements preferably have about the following actual electrical lengths assuming a dipole end effect of 0.7 mounted with a central contact to contact spacing of about 32 mm (1.25"): Referring to FIG. 2C, broadband M-DUV Dipole 24 comprises two M-DUV elements 25 preferably about 250 mm (9.82 in) long; referring to FIG. 2B, the U-DUV 22 dipole comprises two U-DUV elements 23 preferably about 254 mm (6 in) long; referring to FIG. 2D, the V-DUV dipole 26 comprises two V-DUV elements 27 preferably about 305 mm (12 in); and referring to FIG. 2E, an X-DUV dipole 28 comprises two X-DUV elements 29 about 356 mm (14 in) long. Other configurations may use other modular combinations in the range with DUV element actual electrical lengths from about 102 mm (4 in) to about 510 mm (20 in) long. DUV element lengths can be adjusted for different contact to contact distances to maintain the same dipole tip to tip lengths and performance.

Modular RF Director: Referring to FIG. 1, FIG. 4A through FIG. 4E, in some embodiments the driven DUV antenna 12 is enhanced by the modular RF Director 140 selected from a plurality of UHF and/or RF enhancing directors and comprising RF director elements 50. E.g. preferably selected from a short "Urban" UHF Director 142, a medium "Metro" UHF Director 144, and a long "Fringe" UHF Director 146. They may be selected from a medium "Metro" RF director 145 and a long "Fringe" RF director 147. They may selected from a combination of UHF and RF directors.

Figure 4A:
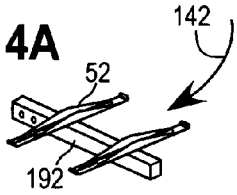
FIG. 4A Short director with two UHF director elements in perspective.

Short "Urban" UHF Director: Referring to FIG. 4*a*, the short "Urban" RF Director 142 may comprise one to three medium UHF director elements 52 mounted on a UHF longitudinal boom or support 192. Urban RF director 142 preferably has two short UHF director elements 52. UHF boom 192 is preferably formed from square tubing. E.g., the UHF boom 192 may be formed from about 6 mm (¼") to 37 mm (1.5") tubing and preferably from about 16 mm (⅝") or 19 mm (¾") square aluminum tubing. It is preferably formed from the same tubing as other director supports to minimize inventory and manufacturing costs.

UHF Director Elements: The conductive portion of UHF director elements 52 may be 152 mm to 216 mm (6 in to 8.5 in) long for 0.5" wide elements. For wideband DTV reception, UHF director elements 52 preferably have an electrical resonant length of about 184 mm (7.25 in) long and 13 mm (0.5 in) wide for a width/length ratio of (0.07). Referring to FIG. 1, FIG. 4A, and FIG. 4C through 4E (and FIG. 19 in the DUV Antenna application), the UHF Director Elements 52 are preferably stiffened to reduce weight and cost while being configured to reduce drag and better withstand wind forces.

Figure 4B:
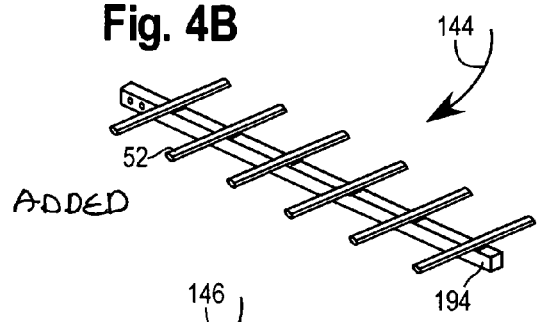
FIG. 4B Medium director with six UHF director elements in perspective.

Referring to FIG. 4B, (and DUV Antenna application FIG. 21), elliptical or similarly streamlined elements of comprising conductive material may be used to reduce wind drag. Director elements 52 are preferably widened to more than 20 mm (0.8 in) with electrical lengths reduced to about 167 mm (6.6 in) for a width/length ratio of 0.12. Director elements 52 are more preferably to about 42 mm (0.67 in) wide with electrical lengths of about 132 mm (5.2 in) for a width/length ratio of 0.32. These are beneficially stiffer in bending and more compact.

UHF Director: The RF Director Elements 50 may be mounted on a modular UHF director boom 190 with director elements 50 spaced about 76 mm to 152 mm (3 in to 6 in) apart starting at about 25 mm to 76 mm (1 in to 3 in) from the YZ plane. Referring to FIG. 4A, a short "Urban" UHF director boom 192 preferably is about 75 mm to 406 mm (3 in to 16 in) long with one to three director elements 52 spaced about 102 mm (4 in) apart, starting about 51 mm (2 in) from the YZ plane (DUV dipole). The short "Urban" UHF boom 192 is preferably about 432 mm (6 in) long supporting about two UHF director elements 52.

Medium Metro UHF Director: Referring to FIG. 4B, the medium "Metro" UHF Director 144 is preferably two to three times as long as the short "Urban" UHF director 142. E.g., Metro UHF Director preferably comprises four to nine UHF director elements 52 mounted on a medium UHF Director boom 194. Metro UHF director 144 more preferably has about six director elements 52 mounted on the medium UHF boom 194 spaced as above.

Figure 4C:
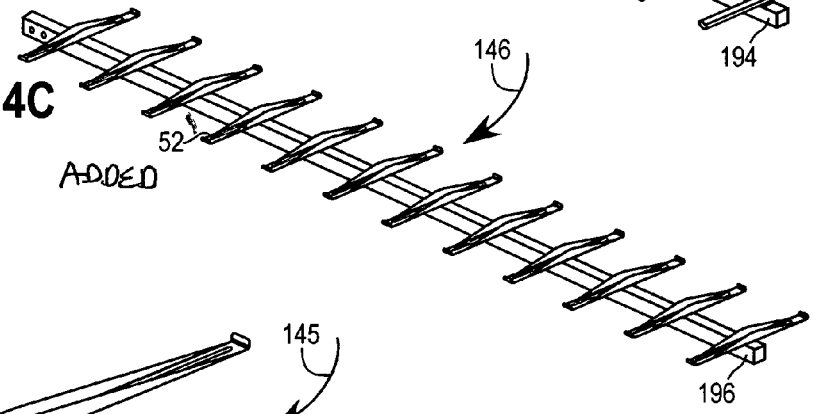
FIG. 4C Long director with twelve UHF director elements in perspective.

Long "Fringe" UHF Director: Referring to FIG. 4C, a long "Fringe" UHF director 146 may be formed with a "Fringe" director boom 196 about 150% to 250% the length of the medium "Metro" UHF director 144. It preferably has ten to twenty four director elements 52, and more preferably about twelve elements 52 mounted on a boom 196 preferably about 1219 mm (48 in) long.

Figure 4D:
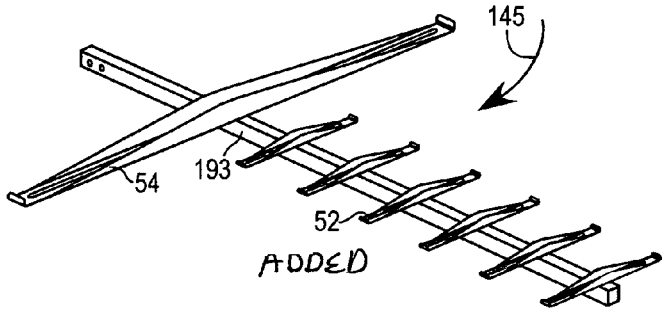
FIG. 4D Short director with six UHF and one VHF director elements in perspective.

Metro RF Director: Referring to FIG. 4D, a medium "Metro" RF director 145 may be formed comprising a combination of medium UHF/VHF director elements 54 and short UHF director elements 52. It preferably has a medium director element 54 about 381 mm to 508 mm (15 in to 20 in) long spaced about 203 mm to 254 mm (8 in to 10 in) from the driven DUV antenna, with about four to nine short director elements 52 and preferably six director elements 52, mounted on a medium director boom 193. Director element 54 is more preferably about 432 mm (17 in) long and is spaced about 235 mm (9.25 in) from the driven DUV antenna with the UHF director elements 52 spaced about 101 mm (4 in) from that.

Figure 4E:
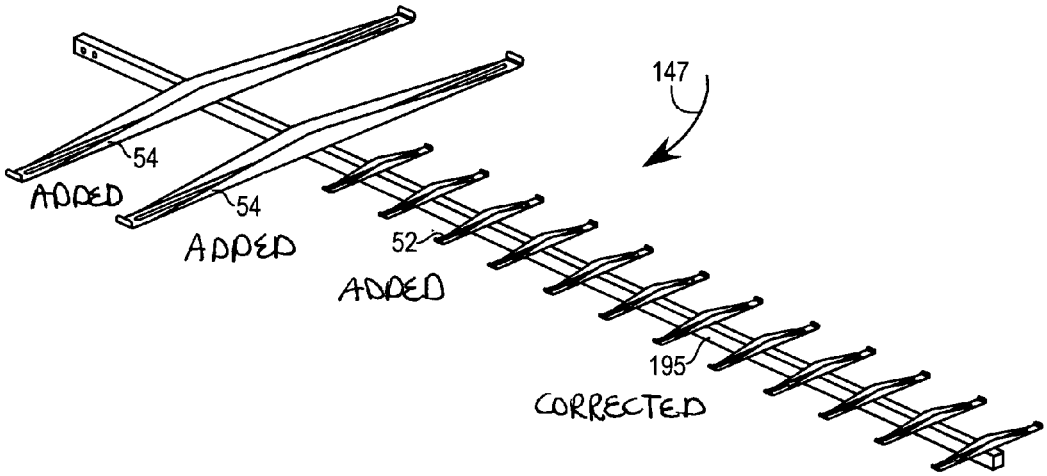
FIG. 4E Medium director with twelve UHF and two VHF director elements in perspective.

Fringe RF Director: Referring to FIG. 4E a long "Fringe" RF director 145 may be formed comprising a combination of medium UHF/VHF director elements 54 and short UHF director elements 52. It preferably has one to three medium director elements 54 about 432 mm (17 in) long spaced about 203 mm to 254 mm (8 in to 10 in) apart. Fringe RF director 145 preferably has about ten to twenty short director elements 52 on a fringe director boom 195. More preferably director 145 has two medium UHFNHF director elements 54 spaced about 229 mm (9 in) apart and twelve UHF director elements 52 spaced about 101 mm (4 in) apart. VHF directors are expected to enhance VHF performance by about 1 dB to 1.5 dB.

Modular Boom Connector: Referring to the embodiment shown in FIG. 1, modular RF Director 140 is preferably connected to the longitudinal boom 102 by a modular connection 70. Referring to FIG. 5B, the modular connection 70 preferably comprises a plug connector 72 which plugs into and connects the director boom 190 and the longitudinal boom 104. In configurations using different dimensions for longitudinal boom 104 and director boom 190, plug connector is preferably configured with differing size ends to match the respective booms. E.g., where the director boom 190 is smaller than the longitudinal boom 102.

The plug connector 72 may be formed from a suitable structural material depending on the design stresses, e.g., an engineering plastic or metal. These booms 104 and 190 are preferably fastened to the plug connector 72 using fasteners inserted through the fastening holes 71. The fastening holes are usually configured vertically to retain the greatest horizontal bending strength in modular connection 70 rather than vertical bending strength. E.g., against horizontal wind loading. This orientation provides space for cable 260 and/or connector 262. The fastener may be a bolt, screw, rivet or pin connecting the longitudinal boom 102, the plug connector 72 and the UHF director boom 190, through respective fastening holes 71.

Figure 5A:
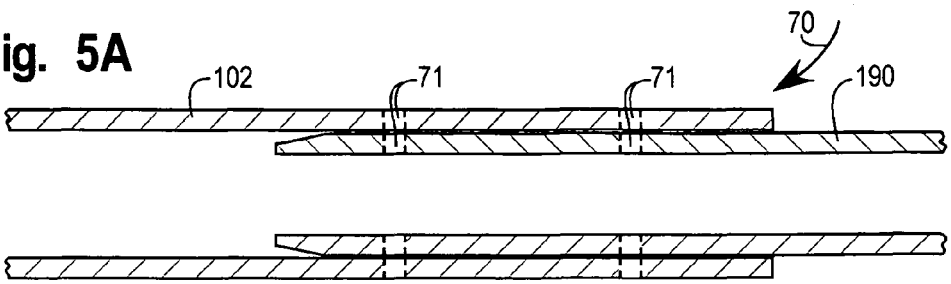
FIG. 5A Boom to boom connection schematic in plan view.
Figure 5B:
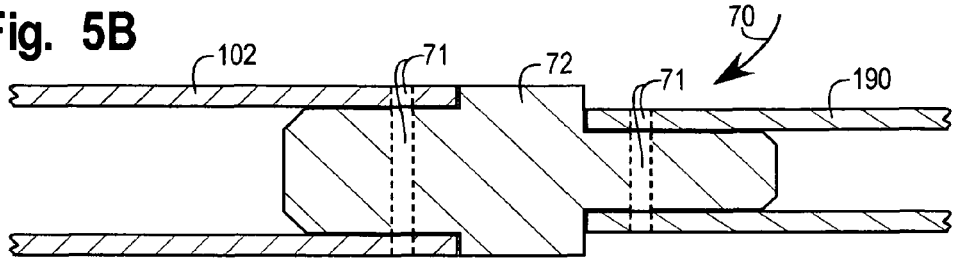
FIG. 5B Insert boom to boom connection schematic in plan view.
Figure 5C:
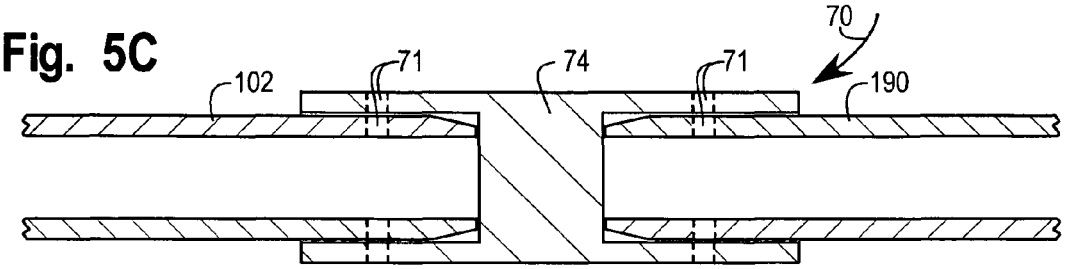
FIG. 5C Sleeve boom to boom connection schematic in plan view.
Figure 5D:
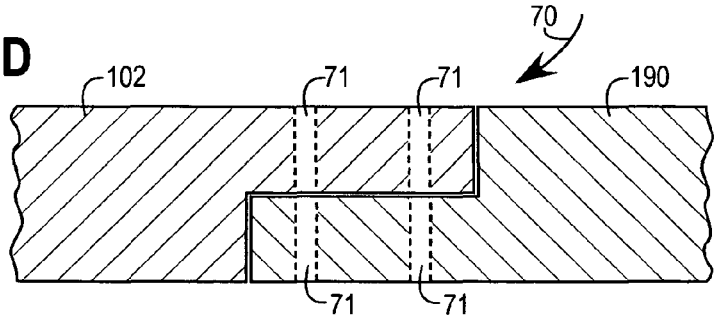
FIG. 5D Overlapping boom to boom connection schematic in plan view.

Referring to FIG. 5A, in another configuration, the modular connection 70 may comprise a plug and socket connection. E.g., where a smaller UHF support boom 190 plugs into a larger longitudinal boom 102. Referring to FIG. 5C, in some configurations, the modular connection 70 preferably comprises a sleeve connector 74 that forms two sockets into which the longitudinal boom 102 and UHF director boom 190 are inserted. This beneficially provides greater bending strength at the joint where needed.

Referring to FIG. 5A, FIG. 5B, and/or FIG. 5C, the outer portion of the smaller boom or plug, and/or the inner portion of the larger boom or sleeve are preferably angled or chamfered for ease of insertion and assembly. Referring to FIG.

5D, the modular connection 70 may comprise overlapping ends on the longitudinal boom 102 and UHF director boom 190. As before, these are preferably fastened together with fasteners through fastener holes 71. Other spring fasteners, cotter pins, glues, solders, welds, or similar mounting or bonding methods may be used to reliably assemble the modular connection 70.

Figure 5E:
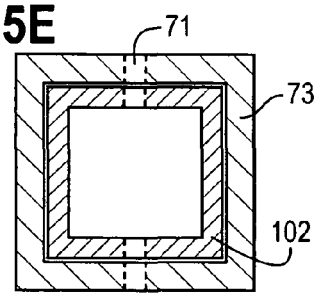
FIG. 5E Surround mounting bracket.
Figure 5F:
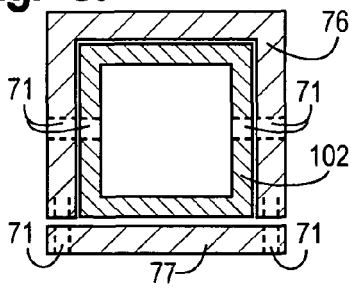
FIG. 5F Cap mounting bracket.

Modular DUV Mount: Referring to FIG. 1 and FIG. 5F, the driven DUV antenna 12 may be mounted over the longitudinal boom 102 using a U connector 76 and one or more suitable fasteners. E.g., using bolts, pins or screws through one or more fastener holes 71. Referring to FIG. 5E, the DUV dipole 12 is preferably configured with a modular sleeve mount 73 that mounts securely around one of the longitudinal boom 102 and the UHF director boom 190.

Figure 3A:
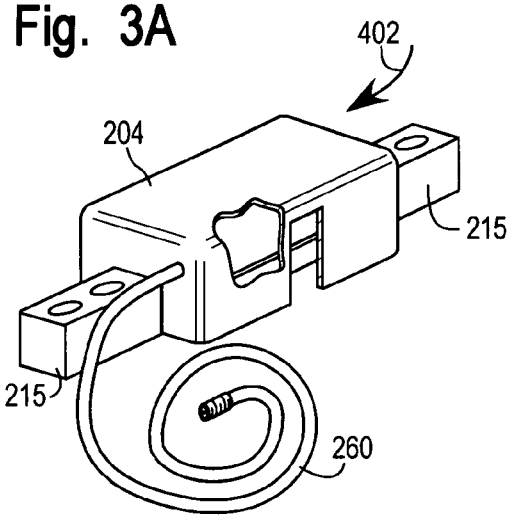
FIG. 3A Base support module with cable in cutout perspective.
Figure 3B:
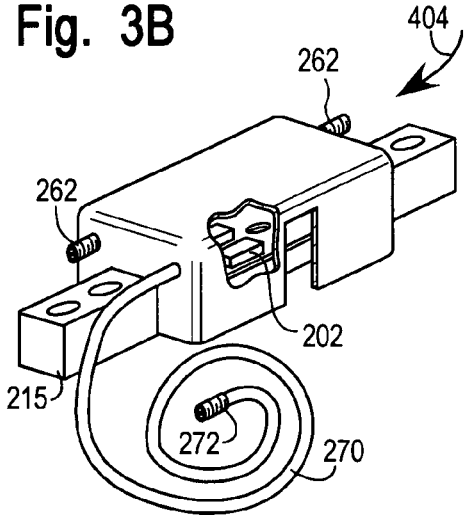
FIG. 3B Amplified support module with cable in cutout perspective.
Figure 3C:
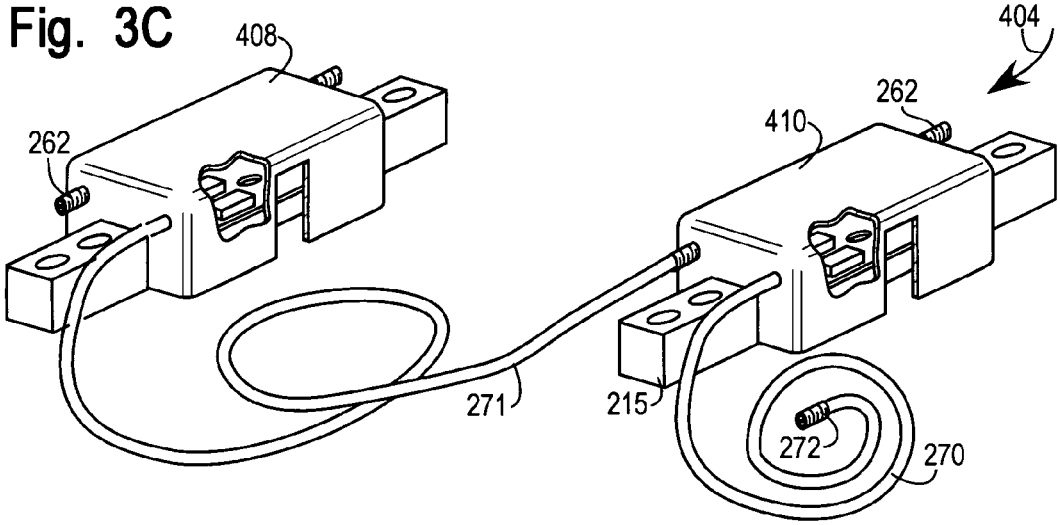
FIG. 3C Dual Diplexed amplified support module with cable in perspective.
Figure 3D:
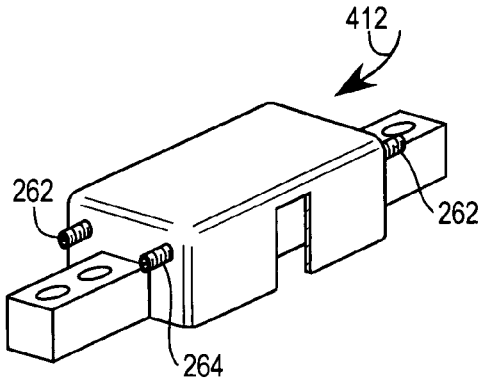
FIG. 3D Diplexed amplified support module with two external inputs.
Figure 3E:
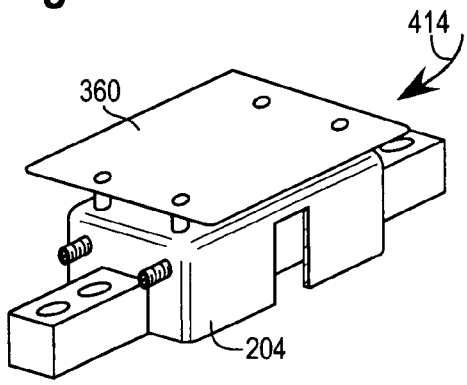
FIG. 3E Support module with solar shield.

Modular DUV/boom mount: Referring to FIG. 3E, in another configuration, the modular mount 70 and the mount for the driven DUV antenna 12 are preferably combined. E.g., the driven DUV antenna 12 is mounted on a sleeve 73 into which are inserted the longitudinal boom 102 and UHF director boom 190. The sleeve mount 73, longitudinal boom 102 and UHF director boom 190 are preferably fastened together with fasteners through fastener holes 71. Similarly, a U connector 76 may be used with a complementary closing plate or bracket 77 to firmly mount the DUV antenna together with the longitudinal boom 102 and the UHF director boom 190. Other fastening, snapping or bonding methods may also be used.

RF Reflector: With reference to FIG. 1 and FIG. 9A, FIG. 9B, and FIG. 9C, in some embodiments the DUV dipole antenna 12 is preferably enhanced by an RF Reflector 170. The RF Reflector 170 is preferably modular and selected from an Urban Reflector 172, a Metro Reflector 174, and a Fringe Reflector 176.

Urban reflector: Urban Reflector 172 preferably comprises a VHF resonant/reflector element 82 preferably mounted transversely across the VHF longitudinal support or boom 104 and about parallel to and in line with the DUV dipole antenna 12. The VHF reflector element 82 may be from about 660 mm (26 in) to 915 mm (36 in) long depending on configuration. For a broadband DTV VHF enhancement configuration, this VHF reflector element 82 is preferably about 864 mm (34") long in some configurations.

This broadband VHF reflector 82 may be positioned from about 27% to 60% of the length of the reflector from the YZ plane through the DUV dipole. It is preferably positioned about 40% of the length of the reflector 82 from the DUV dipole 22, along the positive X direction. E.g., about 349 mm (13.75") from the YZ plane (DUV dipole) on the VHF side in this configuration.

Figure 9A:
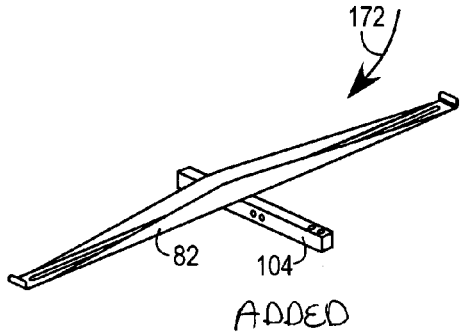
FIG. 9A Short Urban RF Reflector with a VHF reflector in perspective.
Figure 9B:
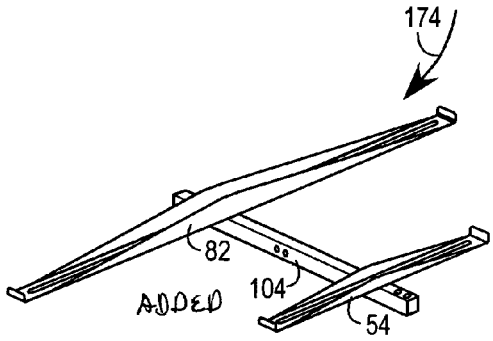
FIG. 9B Medium Metro RF Reflector with VHF and UHF reflectors in perspective.

Metro RF Reflector: With further reference to FIG. 1 and FIG. 9B, some DUV antenna configurations with the RF reflector 170 preferably comprise a UHF resonant/reflective element 54 mounted about transversely across the longitudinal support boom 104. In broadband configurations, UHF reflector 54 is preferably configured to resonate near the low end of the UHF band such as about 450 MHz. E.g., Reflector 54 is preferably about 432 mm (17") long. This beneficially improves UHF performance while not seriously degrading VHF performance. In other configurations UHF reflector 54 is preferably configured to resonate about in the mid UHF range or at prescribed frequencies.

UHF reflector 54 may be positioned about 20% to 33% of UHF reflector length from the YZ plane (DUV dipole). E.g., from 86 to 142 mm (3.4 to 5.6 in). UHF reflector 54 is preferably positioned at about 26% of the length of the UHF reflector 54 from the YZ plane. E.g., at about 114 mm (4.5 in) from the YZ plane for a 432 mm (17 in) UHF reflector. In some embodiments, a medium Metro RF reflector 174 preferably comprises a UHF reflector 54 and a VHF reflector 82.

Figure 9C:
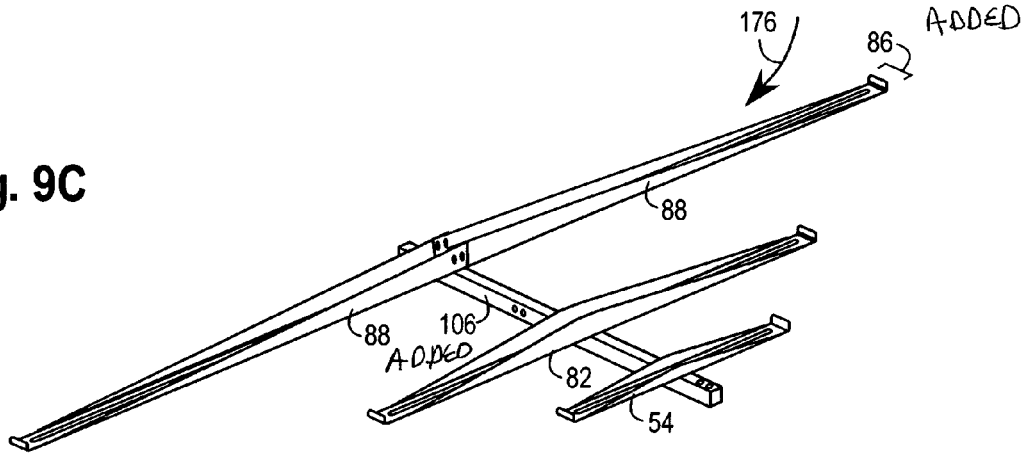
FIG. 9C Fringe RF Reflector with two VHF and one UHF reflectors in perspective.

Large Fringe RF Reflector 176: Referring to FIG. 9C, in some DUV embodiments, RF reflector 170 is configured as a large Fringe RF reflector 176 preferably comprising multiple resonant VHF reflector elements. E.g., RF reflector 176 preferably comprises one medium VHF reflector 82 and one long VHF reflector 86. VHF reflector 86 is preferably about 1.75 m (69 in) long and mounted on a long longitudinal support boom 106 about 698 mm (27.5") from the YZ plane (DUV dipole). VHF reflector 86 is more preferably configured as two half length VHF reflectors 88 of about 900 mm (35.5") long that overlap in the middle by about 50 mm (2"). In some configurations, Fringe RF Reflector preferably comprises a UHF reflector 54.

DUV Performance: To demonstrate the unexpected UHF/VHF improvements of the smaller DUV antennas over the relevant art, three embodiments of DUV antennas were constructed as follows: a small "Urban DUV-U" antenna, a medium "Metro DUV-M" antenna, and a large "Fringe DUV-F" antenna. Cylindrical elements 9.5 mm (0.375 in) diameter were used for all reflective and booster elements in these three DUV test embodiments. Directive elements were of 13 mm (0.5 in) flat stamped material. The components and dimensions were about as follows:

DUV-U "Urban" antenna: Referring to FIG. 1, a small "Urban" unamplified DUV-U antenna embodiment 2 about 0.68 m (27 in) long, having a DUV dipole 20 with DUV elements 21 about 0.24 m and 0.25 m (9.5 in, 10 in) long, a UHF director 140 with three UHF elements 50 each about 188 mm (7.4 in) long, a VHF reflector 82 about 864 mm (34 in) long, and two boosters 110 each having 2 booster reflector elements 62, with the reflector element closest to the X axis about 597 mm (23.5 in) long, and the other one booster reflector element was about 432 mm (17 in) long. A UHF reflector about 432 mm (17 in) long is positioned behind the DUV dipole (such has as shown in FIG. 18.) The typical antenna mass is about 1 kg (2.2 lbs).

Figure 6A:
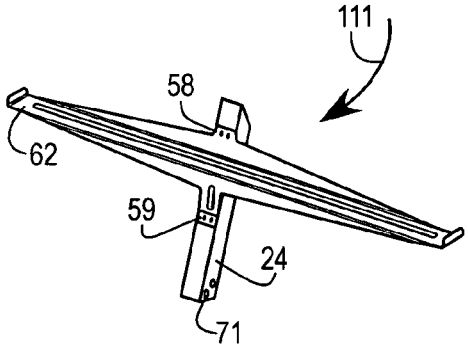
FIG. 6A Small UHF booster with one UHF reflector element in perspective.
Figure 6B:
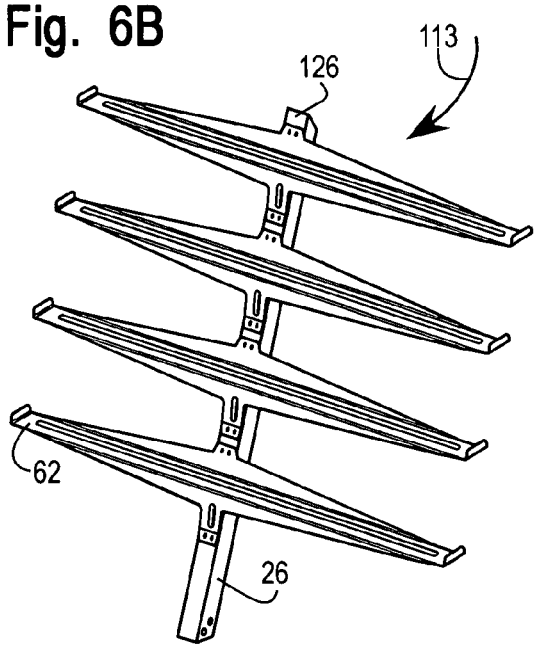
FIG. 6B Medium UHF booster with four UHF reflector elements in perspective.

DUV-M "Metro" antenna: With reference to FIG. 1, FIG. 4B, and FIG. 6B, (and FIG. 18 in the associated technology), a medium sized "Metro" unamplified DUV-M antenna embodiment was configured about 0.97 m (38 in) long, having a DUV dipole with 0.24 m and 0.25 m (9.5 in, 10 in) DUV elements, an RF director 140 with 6 director elements electrically about 188 mm (7.4 in) long, a UHF reflector about 432 mm (17 in) long, a VHF reflector about 864 mm (34 in) long, and two RF boosters 60 each having 4 reflective elements 62, with the reflector element closest to the X axis about 597 mm (23.5 in) long, and the other three booster reflector elements were about 432 mm (17 in) long. The typical mass for this "metro" embodiment is about 1.2 kg (2.6 lbs).

Figure 6C:
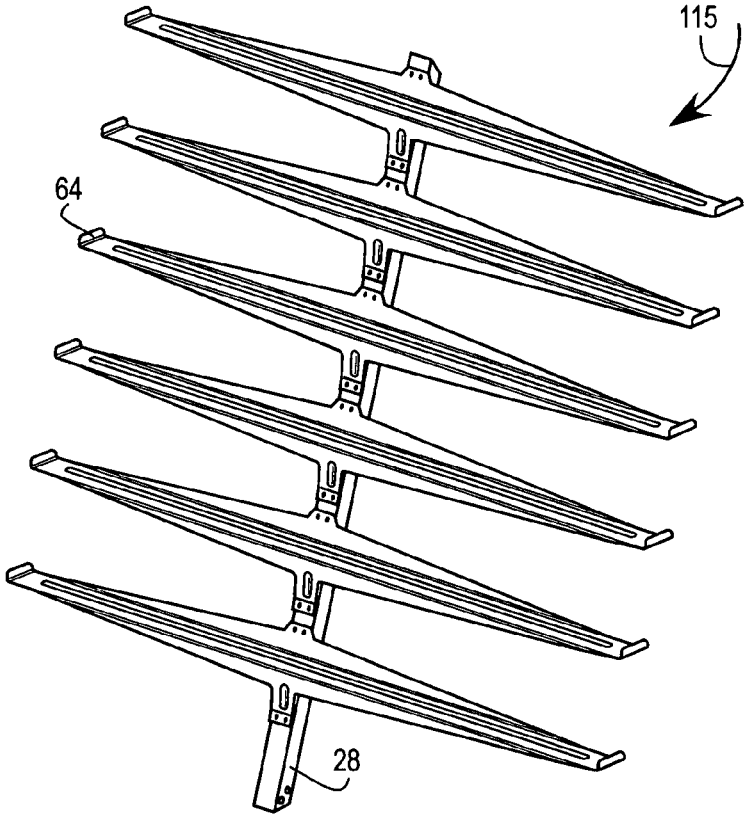
FIG. 6C Large UHF booster with six UHF reflector elements in perspective.

DUV-F Fringe antenna: Referring to FIG. 1, FIG. 4B, FIG. 6C, (and FIG. 18 in the incorporated DUV Antenna application) a large "Fringe" unamplified DUV-F antenna 10 embodiment was configured about 0.97 m (38 in) long, having a DUV dipole 12 with 0.24 m and 0.25 m (9.5 in, 10 in) DUV elements, a director 140 having a boom 126 with 6 director elements 52 each electrically about 188 mm (7.4 in) long, a UHF reflector 54 about 432 mm (17 in) long, a VHF reflector 86 about 864 mm (34 in) long, and two boosters 112 each having 6 elements 64, each element electrically about 864 mm (34 in) long. The typical mass for this embodiment is 1.4 kg (3 lbs).

In these "Urban," "Metro" and "Fringe," DUV embodiments, the booster booms 122 of boosters 110 and 112 were configured with a length about 594 mm (23.38 in) and was mounted on the longitudinal boom 102 with a booster boom mount 120. The outer back edge of the upper booster boom 110 was positioned about 222 mm (8.75 in) along the top of the longitudinal boom 102 from the YZ axis or DUV dipole. In this configuration, the outer forward tip of the booster boom was preferably positioned about 445 mm (17.5 in) from the top of the longitudinal boom, at an angle of about 52 degrees to the longitudinal boom.

In this configuration, the midpoint of the four booster reflector elements was positioned about in the YZ plane or about in line with the DUV reflector. E.g., the booster reflective elements 62 were cut to about 590 mm (23.25") long and positioned at about 168 mm, 289 mm, 417 mm and 556 mm (6.63 in, 11.38 in, 16.44 in and 21.9 in) along the outer boom side up from its junction with the longitudinal boom. The performance includes DUV elements constructed with lengths differing by about 5%.

"Fringe" booster: In the DUV-F embodiment as shown in FIG. 18, a "Fringe" booster was used (similar to a large relevant art UHF corner reflector) with 6 reflective elements about 838 mm (33 in) long on a booster boom about 594 mm (23⅜ in) long. These elements were positioned up from the junction with the longitudinal boom at about 70 mm, 146 mm, 235 mm, 337 mm, 457 mm, and 581 mm (2.75 in, 5.75 in, 9.25 in, 13.25 in, 18.0 in, 22.88 in). This embodiment included elements near the longitudinal axis. In a conventional Yagi/Log-Periodic antenna, these large booster elements would have been expected to cause a major reduction in the VHF gain.

Compared to the DUV-U and DUV-M, the longer elements and restored elements in these larger boosters 112 provided an unexpected increase in the VHF gain of about 1.8 dB at 220 MHz while reducing the VHF gain by 7.1 dB at 180 MHz. Further, this embodiment provide a major unexpected increase in VHF Front/Back ratio of 13.9 dB (from 4.9 to 18.8 dB.) With this excellent Front/Back ratio, an amplified DUV-F configuration with a 20 dB gain would provide a very good broadband gain of about 30 dB in the UHF, and good gain of about 15 dB in the VHF High Band. Yet this is very compact light weight antenna 965 mm (38 in) long, with low wind drag, weighing only about 1.4 kg (3 lbs.)

Relevant Art Antenna Performance: To compare the relative benefits of the DUV antennas, five small "Urban", medium "Metro" and large "Fringe" commercially available Relevant Art antennas advertised as "VHF/UHF" were selected as follows (including some from the FCC Dec. 2005 report 05-199):

RU-WS antenna: A Relevant art unamplified small "Urban" square VHF/UHF antenna about 0.45 m (18") on side, weighing some 4.5 kg (10 lbs) (Winegard "Square-shooter" model SS1000).

RU-AH antenna: A Relevant art unamplified small "Urban" circular VHF/UHF antenna about 0.45 m (18") in diameter weighing some 2.3 kg (5 lbs) (Antennacraft model HDX1000).

RM-WY antenna: A Relevant art unamplified medium "Metro" Yagi VHF/UHF antenna about 1.27 m (50") long with a 6" dipole, 9 element director and a "corner reflector" with 8 elements, weighing 1.2 kg (2.7 lbs) (Winegard Yagi model PR9018).

RM-C4 antenna: A Relevant art unamplified medium "Metro" 4 bay bowtie+screen UHF antenna about 0.56 m×0.86 m (22"×34") weighing about 2.27 kg (5 lbs) (Channel Master model 4221).

RF-C8 antenna: A premium Relevant art unamplified large "Fringe" 8 bay bowtie+screen UHF antenna about 0.91 m×1.02 m (36"×40"), weighing 6.8 kg (15 lbs) (Channel Master model 4228).

Antenna Performance Tests: The performance of these three DUV embodiments and five relevant art antennas was tested for DigiTenna, LLC by Georgia Tech Applied Research Corp. (GTARC) Atlanta Ga., on Jan. 29, 2007 as Project No. SEAL-07-1135. The antenna tests were performed in Georgia Tech's indoor 6.1×11.0 m (20×36 ft) RF anechoic instrumented Shielded Antenna Chamber. GTARC uses an FR 959 automated antenna measurement system with broadband HP synthesized sources and a HP 8510-based Vector Network Analyzer. The FCC certified instrumentation can test antennas from 200 MHz to 110 GHz and was calibrated in November 2006. All antennas were tested under identical conditions. All gains were corrected upward by 0.20 dB to adjust for insertion loss, and had a standard deviation of about 0.17 dB.

Unamplified Antenna Performance: The measured Front gain of five unamplified DigiTenna antenna embodiments are shown in Table 1 for three frequencies, (180 MHz, 200 MHz, and 220 MHz), representing the bottom, middle and top of the VHF High Band (near DTV Channels 7, 10 and 13). These include small Urban DUV-U, medium Metro DUV-M, and large Fringe DUV-F embodiments. Corresponding gains are shown for four UHF frequencies, (475 MHz, 550 MHz, 625 MHz, and 700 MHz), representing the bottom, middle and top of the US DTV UHF band (near DTV Channels 14, 27, 39, and 52). The gain of these DUV antenna embodiments is graphed in FIG. 23. Five major commercial relevant art unamplified antennas are shown for comparison. Note: All amplifiers in commercial antennas were removed for these tests.

TABLE 1

Antenna Front Gain in VHF Hi Band & DTV UHF

| | Frequency MHz | | | | | | |
|---|---|---|---|---|---|---|---|
| | 180 dB | 200 dB | 220 dB | 475 dB | 550 dB | 625 dB | 700 dB |
| DigiTenna | | | | | | | |
| DUV-U | −0.75 | −2.07 | −3.50 | 7.56 | 7.21 | 7.99 | 8.39 |
| DUV-UC | 0.0 | −0.3 | −0.7 | 5.5 | 5.6 | 5.9 | 6.0 |
| DUV-M | −1.41 | −2.69 | −3.63 | 8.66 | 8.01 | 9.86 | 10.50 |
| DUV-MC | −0.6 | −0.9 | −0.8 | 8.9 | 8.6 | 9.7 | 10.3 |
| DUV-F | −8.52 | −4.90 | −1.77 | 11.44 | 11.00 | 11.57 | 10.50 |

TABLE 1-continued

| Antenna Front Gain in VHF Hi Band & DTV UHF | | | | | | | |
|---|---|---|---|---|---|---|---|
| | Frequency MHz | | | | | | |
| | 180 dB | 200 dB | 220 dB | 475 dB | 550 dB | 625 dB | 700 dB |
| Relevant Art | | | | | | | |
| RU-WS SS1000 | −36.23 | −25.00 | −25.67 | 2.55 | 3.49 | 5.48 | 1.41 |
| RU-AH HDX1000 | −17.70 | −13.40 | −10.62 | 8.86 | 7.58 | 8.96 | 8.94 |
| RM-WY PR9018 | −22.82 | −25.11 | −27.98 | 8.00 | 8.21 | 7.59 | 10.81 |
| RM-C4 4221 | −19.55 | −11.62 | 2.35 | 9.51 | 10.70 | 10.96 | 12.51 |
| RF-C8 4228 | −2.60 | 6.64 | 3.28 | 13.77 | 13.62 | 13.14 | 12.19 |

Relative Antenna Performance: The relative performance of these small Urban, medium Metro and large Fringe DUV antenna embodiments are shown in Table 1 compared to the corresponding five relevant art antennas. Table 2 lists the average gain in the VHF High Band, the UHF DTV band, and the Mean of the VHF and UHF gains. It lists the Mass, Mean Gain/Mass and the difference between the mean UHF and VHF gains. Table 3 shows the difference between the gains of these DigiTenna embodiments and gains of comparable relevant art antennas for the corresponding frequencies and averages. The DigiTenna DUV antenna embodiments generally have comparable UHF performance to the relevant art antennas. However, the DUV antenna VHF gains were 7 dB to 26 dB greater than the relevant art antennas for Urban and Metro configurations. The DUV antenna's wideband Gain/Mass ratio is 1 to 10.8 dB/kg higher than major competitors.

TABLE 2

| Antenna VHF, UHF Gains, Gain/Mass and Wideband Comparisons | | | | | | |
|---|---|---|---|---|---|---|
| | VHF Hi Avg dB | UHF DTV Avg dB | Mean dB (VHi + U)/2 | Mass kg | Gain/ Mass dB/kg | UHF-VHF Avg dB |
| DigiTenna | | | | | | |
| DUV-U | −2.11 | 7.79 | 2.84 | 1.0 | 2.8 | 9.89 |
| DUV-UC | −0.3 | 5.8 | 2.7 | 0.9 | 3.0 | 6.1 |
| DUV-M | −2.58 | 9.26 | 3.34 | 1.2 | 2.8 | 11.83 |
| DUV-MC | −0.8 | 9.4 | 4.3 | 1.1 | 3.9 | 10.2 |
| DUV-F | −5.06 | 11.13 | 3.03 | 1.4 | 2.2 | 16.19 |
| Relevant Art | | | | | | |
| RU-WS SS1000 | −28.97 | 3.23 | −12.87 | 4.5 | −2.9 | 32.20 |
| RU-AH HDX1000 | −13.91 | 8.59 | −2.66 | 2.3 | −1.2 | 22.49 |
| RM-WY PR9018 | −25.30 | 8.65 | −8.33 | 1.2 | −6.9 | 33.96 |
| RM-C4 4221 | −9.61 | 10.92 | 0.66 | 2.3 | 0.3 | 20.53 |
| RF-C8 4228 | 2.44 | 13.18 | 7.81 | 6.8 | 1.1 | 10.74 |

TABLE 3

| Difference in Gains between DigiTenna and Relevant Art Antennas | | | | | | |
|---|---|---|---|---|---|---|
| | VHF Hi Avg dB | UHF DTV Avg dB | Mean dB (Vhi + U)/2 | Mass kg | Gain/ Mass dB/kg | UHF-VHF Avg dB |
| DUV-U vs RS-WS | 26.86 | 4.56 | 15.71 | −3.50 | 5.70 | −22.31 |
| DUV-U vs RS-AH | 11.80 | −0.80 | 5.50 | −1.30 | 4.00 | −12.60 |
| DUV-UC vs RS-WS | 29.3 | 2.6 | 15.6 | −3.6 | 5.9 | −26.4 |
| DUV-UC vs RS-AH | 14.2 | −2.8 | 5.4 | −1.4 | 4.2 | −18.4 |
| DUV-M vs RM-WY | 22.73 | 0.61 | 11.67 | 0.00 | 9.72 | −22.12 |
| DUV-M vs RM-C4 | 7.03 | −1.66 | 2.68 | −1.50 | 2.54 | −8.69 |
| DUV-MC vs RM-WY | 24.5 | 0.7 | 12.6 | −0.1 | 10.8 | −23.8 |
| DUV-MC vs RM-C4 | 8.8 | −1.5 | 3.6 | −1.2 | 3.6 | −10.3 |
| DUV-F vs FL-C8 | −7.50 | −2.05 | −4.78 | −5.40 | 1.02 | 5.45 |

Table 4 shows the Front/Back Ratios of the three DUV embodiments together with the five relevant art antennas. (I.e., Forward gain at 0 deg minus back gain at 180 deg.) Table 5 shows the differences between the Front/Back Ratios of the three DUV embodiments with the corresponding Relevant Art antennas of similar size. The DUV embodiments showed a little smaller but competitive UHF Front/Back ratios to most Relevant Art antennas. However, the VHF Front/Back ratios of the DUV antennas were typically 5 dB to 23 dB higher across most of the DTV VHF High Band than most relevant art antennas. This helps in isolating and amplifying competing DTV signals. Individual performance is discussed below.

TABLE 4

Front/Back Ratio of DigiTenna and Relevant Art Antennas

| | Frequency MHz | | | | | | | | |
|---|---|---|---|---|---|---|---|---|---|
| | 180 dB | 200 dB | 220 dB | 475 dB | 550 dB | 625 dB | 700 dB | VHF Avg | UHF Avg |
| DigiTenna | | | | | | | | | |
| DUV-U | 8.5 | 5.2 | 3.7 | 18.4 | 18.0 | 18.4 | 16.9 | 5.8 | 17.9 |
| DUV-M | 7.5 | 4.1 | 3.1 | 20.8 | 18.9 | 19.4 | 18.8 | 4.9 | 19.5 |
| DUV-F | 12.5 | 20.0 | 23.8 | 25.9 | 24.2 | 24.5 | 19.8 | 18.8 | 23.6 |
| Relevant Art | | | | | | | | | |
| RS-WS | −14.8 | −2.3 | −7.7 | 5.4 | 10.9 | 16.4 | 23.0 | −8.3 | 13.9 |
| RS-AH | −2.2 | −0.5 | −0.4 | 15.2 | 21.9 | 23.0 | 18.0 | −1.0 | 19.5 |
| RM-WY | 3.0 | 1.8 | 5.8 | 24.6 | 27.6 | 25.4 | 21.9 | 3.5 | 24.9 |
| RM-C4 | −5.3 | −4.0 | −3.1 | 20.5 | 21.6 | 24.5 | 23.0 | −4.1 | 22.4 |
| RF-C8 | −0.7 | 14.8 | 11.6 | 25.1 | 37.7 | 30.0 | 25.8 | 8.6 | 29.7 |

TABLE 5

DigiTenna versus Relevant Art Front/Back Ratio Comparisons

| | Frequency MHz | | | | | | | | |
|---|---|---|---|---|---|---|---|---|---|
| | 180 | 200 | 220 | 475 | 550 | 625 | 700 | VHF | UHF |
| DUV-U vs RS-WS | 23.3 | 7.6 | 11.4 | 13.0 | 7.1 | 2.0 | −6.2 | 14.1 | 4.0 |
| DUV-U vs RS-AH | 10.7 | 5.7 | 4.1 | 3.3 | −3.9 | −4.6 | −1.2 | 6.8 | −1.6 |
| DUV-M vs RM-WY | 4.5 | 2.3 | −2.8 | −3.8 | −8.7 | −6.0 | −3.1 | 1.3 | −5.4 |
| DUV-M vs RM-C4 | 12.9 | 8.0 | 6.1 | 0.4 | −2.7 | −5.1 | −4.2 | 9.0 | −2.9 |
| DUV-F vs RF-C8 | 13.2 | 5.2 | 12.2 | 0.7 | −13.5 | −5.5 | −6.1 | 10.2 | −6.1 |

Urban DUV-U Antenna Performance: The small "Urban" DUV-U antenna shows a good average UHF gain of 7.7 dB. This is 4.4 dB higher than RU-WS and within 0.8 dB of RU-AH. The DUV-U's average UHF Front/Back ratio is a very good 17.9 dB, 3.9 dB higher than the FCC's UHF plan of 14 dB. This is 4 dB higher than RU-WS and within 2 dB of RU-AH. Unexpectedly, the DUV-U antenna's average VHF gain is −2.2 dB. This is 27.3 dB higher than the relevant small antenna RU-WS and 11.7 dB higher than the RU-AH antenna. Yet, the DUV-U weighs about 1 kg (2.2 lbs), or only 22% the weight of the 4.5 kg (10 lbs) RU-WS antenna. The DUV-U has much lower wind drag than both of the relevant RU-WS and RU-AH antennas. Unexpectedly, the DUV-U antenna's VHF Front/Back ratio is 5.8 dB. This is 14.1 dB higher than RU-WS and 6.8 dB higher than RU-AH (which both have negative VHF F/B ratios.) This provides critical advantages under urban conditions with high multipath and strong interfering stations.

DUV-M "Metro" Antenna Performance: The medium sized "Metro" DUV-M embodiment has an average UHF DTV gain of about 9.1 dB. This UHF gain is competitive with about 0.6 dB higher than RM-WY, and within 1.6 dB of the RM-C4. The DUV-M's UHF Front/Back ratio is a very good 19.5 dB, 5.5 dB higher than the FCC's 14 dB plan. The DUV-M's F/B is 5.6 dB higher than the RM-WY and about equal to the RM-C4. Unexpectedly, the DUV-M has a much higher VHF High Band gain, with an average VHF gain of about −2.5 dB. This is about 22.7 dB higher VHF gain than the relevant medium RM-WY antenna.

The DUV-M has 18.2 dB higher VHF gain at 180 MHz (about DTV Channels 7-8) than the RM-C4, and 8.9 dB higher at 200 MHz. Yet the DUV is only 965 mm (38 in) long. I.e., it is about 305 mm (12 in) shorter than the PRM-WY, and similar to RM-C4. Furthermore, the DUV-M has a VHF Front/Back ratio of 4.9 dB. This is 1.4 dB higher than RM-WY, and 9 dB higher than RM-C4 (which has a negative F/B ratio). Higher F/B ratios give the DUV-M critical advantages under conditions with high multipath and strong interfering stations.

DUV-F "Fringe" Antenna Performance: The large DUV-F "Fringe" embodiment has a UHF DTV gain of +11.1 dB, within 2 dB of the relevant RF-C8. The DUV-F has an average VHF High Band gain of −5.1 dB which is nominally 7.9 dB lower. Unexpectedly, the DUV-F has an excellent average VHF Front/Back ratio of 18.8 dB, or 6.8 dB above the FCC's 12 dB planning factor. The DUV-F's F/B ratio is 10.2 dB higher than the premium 8 bay bowtie RF-C8's 8.6 dB VHF F/B. This is due to the RF-C's poor performance in major portions of the VHF High Band.

This F/B performance enables an amplified DUV-F to lock in to poor fringe broadcast signals where an amplified RF-C8 fails. Furthermore, the RF-C8 has 22 unsealed connection points which often degrade severely over time due to corrosion. The DUV-F with only 2 sealed connection points maintains its performance. At about 1.4 kg (3 lb), the DUV-F is only 20% as heavy as the RF-C8 at 6.8 kg (15 lb). Furthermore, the DUV-F ships in a compact sturdy box at standard rates compared to the RF-C8 which requires oversized shipping and often experiences shipping damage.

Compact Urban DUV Antenna: Referring to FIGS. 1, 2C, 3A, 4A, and 6A, the small Urban U-DUV antenna embodiment described above was modified to form a compact Urban Antenna by reducing the number of booster reflectors from two to one above and below the XY plane, and by reducing the number of UHF director elements from three to two. The length of round booster reflectors 62 were reduced from about 584 mm (23 in) to about 438 mm (17 in) to about match the length of the UHF reflector 54.

DUV-UC Compact "Urban" Antenna Performance: Referring to Table 1, this compact Urban DUV antenna configuration unexpectedly showed a substantial improvement in VHF performance by about 0.8 dB near 180 MHz, about 1.8 dB near 200 MHz, and about 2.8 dB near 220 MHz from internal comparative tests. The UHF performance also improved about 1.5 dB from channels 28 through about channel 51. The configuration shows wideband performance in the VHF high band similar to a VHF dipole about 743 mm (29.25 in) long. E.g., at about 0 dB for 180 MHz and 220 MHz. It further showed wideband UHF performance with about 5 dB gain at about 475 MHz and 700 MHz near the ends of the DTV band. This configuration maintained excellent front/back ratios of about 10 dB in the VHF High band and about 15 dB in the UHF DTV region. (Third party tests are expected to eliminate most of the skewness coming from the asymmetric DUV elements in the earlier tests.)

DUV-MC Compact Metro Antenna: Referring to FIGS. 1, 2C, 4B, and 6B, the medium "Metro" M-DUV antenna embodiment described above was modified to form a compact "Metro" DUV Antenna by reducing the length of a round booster reflectors 62 from about 584 mm (23 in) to about 238 mm (17 in) to about match the length of the UHF reflector 54.

DUV-MC Performance: Referring to Table 1, this compact Metro DUV antenna configuration unexpectedly showed a substantial improvement in VHF performance (relative to DUV-M) by about 0.8 dB near 180 MHz, about 1.8 dB near 200 MHz, and about 2.6 dB near 220 MHz from internal comparative tests. The configuration shows wideband performance in the VHF high band similar to a VHF dipole about 743 mm (29.25 in) long. E.g., at about 0 dB for 180 MHz and 220 MHz. The UHF performance was within about 0.4 dB from 475 MHz to 700 MHz. It further showed wideband UHF performance with about 9.4 dB gain across the DTV band.

Gain per Mass: The superiority of the DUV antenna configuration method is further shown by comparing the DUV antenna wideband Gain/Mass versus major competitors. Referring to Table 2, this is evaluated as the mean of the average VHF High Band gain and DTV UHF gain for the 3 and 4 frequencies shown in Table 1, divided by the mass M of the antenna. I.e., (VHi+U) divided by (2*M). See Table 1. The DUV-U and DUV-M with a wideband Gain/Mass of 2.8 dB/kg are remarkably superior to commercial units having wideband Gain/Mass ranging from −6.9 to 0.2 dB/kg. The compact DUV-UC and DUV-MC configurations show even greater wideband Gain/Mass performance of 3.0 and 3.9 dB/kg. Even the premium VHF/UHF Fringe eight bowtie antenna RF-C8 has a wideband Gain/Mass of only 1.1 dB/kg compared to 2.2 dB/kg for the Fringe DUV-F. None of the commercial units tested had a wideband Gain/Mass greater than 1.3 dB/kg, while all the DUV antennas had a wideband Gain/Mass greater than 2 dB/kg.

Wideband Gain Difference: The superior VHF UHF wideband performance of the "Urban" DUV-U and "Metro" DUV-M antennas is further shown by the difference between the average gains of the UHF DTV band and the VHF High Band, shown as UHF-VHF in Table 1. These UHF vs VHF gain differences in DUV-U and DUV-M antennas are within 10 and 12 dB. Compact DUV-UC and DUV-MC antennas showed even lower differences within 7 and 11 dB. By contrast, major small "Urban" and medium "Metro" competitors advertised as VHF/UHF antennas show at least 20 dB UHF-VHF differences and range up to a difference of 34 dB in the "Front" or 0 deg direction. The large DUV-F "Fringe" antenna with a UHF-VHF wideband difference of 16.2 dB is within about 6 dB of the 10.7 dB difference of the premium large "Fringe" 8 bay bowtie RF-CS which weighs five times as much.

Housing/Amplifier Module: Referring to FIG. 1, and FIG. 3A through FIG. 3E, the DUV antenna system preferably comprises a housing module 400 to support the driven DUV element 21 and the RF signal connector 262 and/or RF signal line 260. Referring to FIG. 3A housing module 402 comprises the RF signal line 260 preferably connected to the driven DUV elements 21 and potted inside a housing 204. Antenna mount 100 preferably comprises modular connector 70 which preferably comprises two mounting tongues 215 attached to housing module 402 to connect to one or both of longitudinal boom 104 and director boom 190. Longitudinal boom 104 is preferably connected to mast 150 by mast-antenna mount 153.

Amplified housing module: Referring to FIG. 3B, in some embodiments the RF enhancer preferably comprises an amplifier/housing module 404 comprising an RF amplifier 202 configured within housing 204. Amplifier 202 is preferably RF communicatively connected to driven DUV dipole 20 and to an RF optical signal line 270 having optical connector 272. Module 404 preferably has one and more preferably two signal connectors 262 diplexed to signal line 270. E.g., in some configurations these are preferably configured for an RF satellite connection and/or a high UHF or internet connection. Module 404 preferably comprises mounting tongues 215.

Dual amplifier/housing module: Referring to FIG. 3C, in some embodiments a dual amplifier/housing module 406 preferably comprises an amplified module 410 similar to amplified module 404, and which is RF communicatively connected to an extension amplified module 408 by preferably an RF connecting line and more preferably by DUV optic connecting line 271. Like module 404, dual amplifier module 406 preferably comprises one and more preferably two signal connectors 262 diplexed to RF signal line 270. Module 404 preferably comprises mounting tongues 215.

Diplexed amplifier/housing module: Referring to FIG. 3D, in some embodiments an amplifier/housing module 412 is configured like amplifier/housing module 404 with an RF amplifier communicatively connected to driven dipole and signal outlet 264 which is preferably diplexed to two signal connectors 262.

Solar shielded amplifier/housing module: Referring to FIG. 3E, a modular solar shield 360 is preferably configured to be mountable on one and preferably all of the housings 204 in amplifier/housing modules 404, 408, 410, and 412. Solar shield 260 may also be configured with amplifier/housing module 412 to form shielded amplifier/housing module 414. There is preferably an air gap between solar shield 360 and housing 204. The outer surface of solar shield 360 is preferably configured with a reflective optical coating having a low absorptive reflective coating in the visible, and more preferably with a high infrared emissivity to radiate heat.

Internet Amplifier/Housing module: Referring to FIG. 3B through 3E, one of amplifier/housing modules 404, 406, 412, and 414 are preferably configured for both transmitting and receiving RF signals to enable two way RF communications. E.g., preferably in the high UHF range from 700 MHz to 801 MHz for internet communications. The requisite IP amplifiers and filters are preferably electrically bonded to and potted together with the respective DUV element contacts and signal line 270 or contacts 262.

Figure 7A:
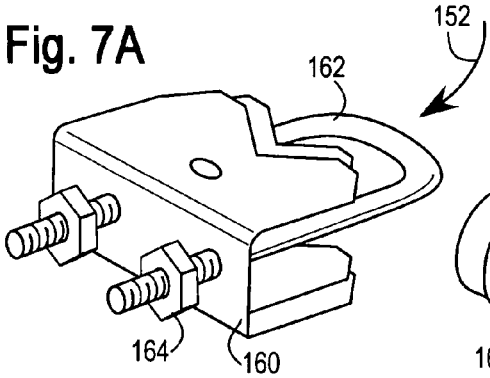
FIG. 7A Exterior boom-mast mount in perspective.
Figure 7B:
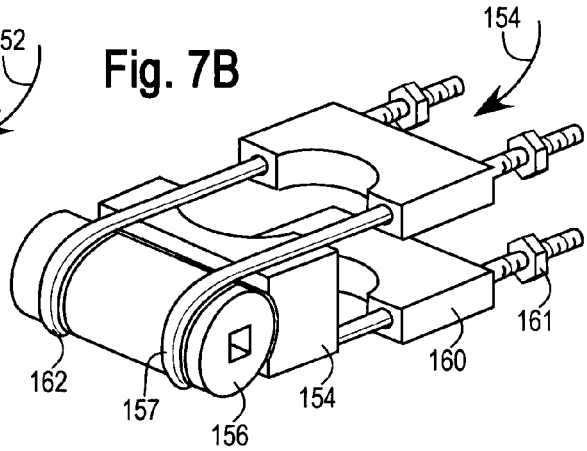
FIG. 7B Exterior dual axis adjustable boom-mast mount in perspective.

Antenna Mount: Referring to FIG. 1 and FIG. 7A through FIG. 7D, the DUV antenna system preferably comprises a modular antenna mount 153 comprising one of an external mast-antenna mount or an internal antenna mount. Referring to FIG. 7A and FIG. 7B, more preferably, the internal antenna mount comprises one of a single axis mast-antenna mount 152 and a dual-axis orientable mast-antenna mount 154. Single axis orientable mount preferably comprises a curvilinear bolt 162, two clamping cams or nuts 161 and dual hole washer to clamp longitudinal boom 102 to antenna mast (not shown. See DUV antenna disclosure FIG. 1, FIG. 15). This enables positioning the antenna along and about the antenna mast. E.g., vertically and about the vertical axis.

Per FIG. 7B, dual axis antenna-mast mount 154 more preferably enables orientation with three degrees of freedom including about an axis normal to the antenna mast. e.g., to adjust for polarization about the horizontal axis. As described in the DUV application, dual axis mount 154 utilizes two curvilinear bolts 162 to clamp curved boom support 156 against bicurved mount 154 onto the antenna mast (not shown) with four cams or nuts 161 clamping two dual hole washers 160.

Figure 7C:
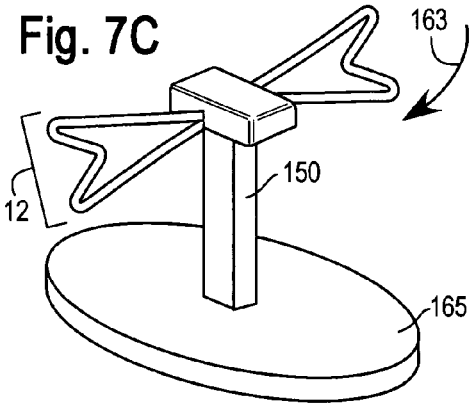
FIG. 7C Interior boom-mast mount in perspective.
Figure 7D:
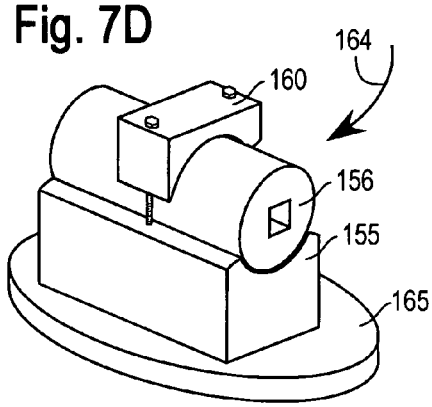
FIG. 7D Interior dual axis adjustable boom-mount in perspective.

Indoor Antenna Mounts: Referring to FIG. 7C and FIG. 7D, modular antenna mounts preferably include a standard indoor antenna mount 163 and dual axis antenna mount 164 to support driven DUV antenna 12 on indoor antenna base 165, in a similar fashion to the external 152 and 154.

Figure 8A:
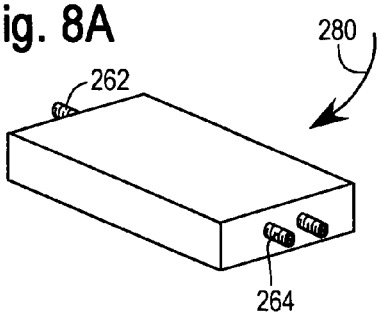
FIG. 8A Signal splitter module with one input and two outputs.
Figure 8B:
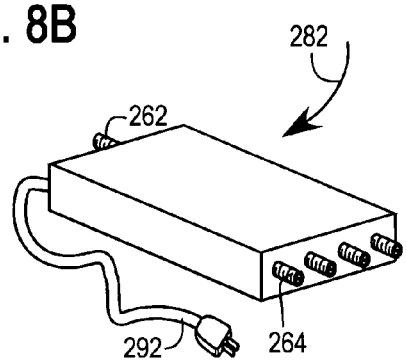
FIG. 8B Active signal distributor with one input and four outputs.
Figure 8C:
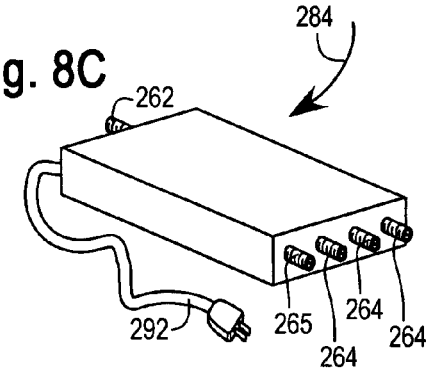
FIG. 8C Active signal distributor with bidirectional and standard contacts.

Signal splitter: Referring to FIG. 8A, FIG. 8B and FIG. 8C, the modular DUV antenna system preferably comprises a modular signal junction box selected from a passive signal splitter 280, an active signal distributor 282, and an active signal multiplexer. Signal splitter 280 may be a passive splitter having one signal input 262 and multiple signal connectors 264. Signal distributor 282 preferably comprises a power cable 292 and powered amplifier to distribute signals to multiple signal connectors 264 without major signal dilution and loss experienced by conventional passive splitters.

More preferably signal junction box comprises signal multiplexer 284 which provides for multiplexing signals through multiple signal connectors 264. These preferably include input/output connectors for Internet signals as well as DTV signal outputs. Signal connectors 262 are more preferably fiber optic connectors to fiber optic signal lines to reduce signal loss and avoid adding noise in one or both of signal distributor 282 and signal multiplexer 284.

Amplifier gains: Modular amplifiers are configured to provide multiple gain configurations in some embodiments, such as low, medium, and high gain as needed. E.g., these may be from 6 dB to 10 dB, from 11 dB to 20 dB, and from 21 dB to 30 dB. A switch selectable amplifier is more preferably provided.

Potting Housing/Amplifier Combinations: With reference to FIG. 2A through FIG. 2E, and FIG. 3A through FIG. 3E, the combinations of driven DUV elements, amplifier configurations, and amplifier gains would quickly result in a large number of combinations. More preferably, the separate driven antenna elements of FIG. 2B through 2E, the housing options and mounts of FIG. 3A through 3E, the cable options of FIG. 3A through 3C, and the amplifier modules without different gain options are preferably provided. Then selections of these components are configured and then bonded and/or potted together to form durable housing/amplifier modules with desired combinations of features.

Container: Referring to FIG. 1, the modular DUV antenna system 2 is preferably configured such that most combinations of modules fit into a common container or box. E.g., a container with about 1054 mm×946 mm×171 mm (41.25 in×37.25 in×6.75 in) inner dimensions can be used for Urban, Metro and Fringe models. In some configurations, the outer portions of the VHF reflector 80 are folded back about 51 mm (2 in) each along the X axis towards the DUV dipole 22. This reduces the width of the container by about 102 mm (4 in) from 946 mm to 844 mm (37.25 to 33.25 in) resulting in a more compact container. In further configurations, the VHF reflector is not attached for shipping, reducing the container by about half while requiring minimal assembly.

Generalization

From the foregoing description, it will be appreciated that a novel approach for forming modular Digital UHF/VHF antennas has been disclosed using one or more methods described herein. While the components, techniques and aspects of the invention have been described with a certain degree of particularity, it is manifest that many changes may be made in the specific designs, constructions and methodology herein above described without departing from the spirit and scope of this disclosure.

Where dimensions are given they are generally for illustrative purpose and are not prescriptive. As the skilled artisan will appreciate, other suitable materials and components may be efficaciously utilized, as needed or desired, giving due consideration to the goals of achieving one or more of the benefits and advantages as taught or suggested herein.

While certain modular antenna configurations, driven elements, director elements, reflector elements, resonant elements, amplifiers, lines, baluns, bonds, supports and mounts are shown in some configuration for some embodiments, combinations of those configurations may be efficaciously utilized. The active and/or passive element lengths, heights, spacing and other element, component, and structural dimensions and parameters for antenna systems may be used.

Where the terms RF, VHF, UHF, FM, Internet, driven, active, passive, reflector, and director have been used, the methods are generally applicable to other combinations of those elements. Where streamlined and/or tapered elements are described, other stamped or cylindrical elements may be used. Configurations utilizing stiffened elements may use unstiffened elements.

Where assembly methods are described, various alternative assembly methods may be efficaciously utilized to achieve configurations to achieve the benefits and advantages of one or more of the embodiments as taught or suggested herein.

Where longitudinal, axial, transverse, vertical, orientation, or other directions are referred to it will be appreciated that any general coordinate system using curvilinear coordinates may be utilized. Similarly, the antenna element orientations may be generally rearranged to achieve other beneficial combinations of the features and methods described.

While the components, techniques and aspects of the invention have been described with a certain degree of particularity, it is manifest that many changes may be made in the specific designs, constructions and methodology herein above described without departing from the spirit and scope of this disclosure.

Various modifications and applications of the invention may occur to those who are skilled in the art, without departing from the true spirit or scope of the invention. It should be understood that the invention is not limited to the embodiments set forth herein for purposes of exemplification, but includes the full range of equivalency to which each element is entitled.

We claim:

1. A modular Digital UHF/VHF (DUV) antenna system having a forward pointing X axis comprising:

a driven DUV antenna having a driven DUV element RF communicatively connected to an RF signal line and antenna mount supporting the DUV element; and a modular RF signal enhancer, supported by the antenna mount, and selected from:

an RF amplifier RF communicatively connected to the driven DUV element, and a passive RF enhancer, positioned to enhance the RF performance of the DUV antenna, selected from one of:

an RF director in front of the DUV element attached by a modular director connection, an RF reflector behind the DUV element attached by a modular reflector connection, and an off axis RF booster attached by a modular booster connection.

2. The modular DUV antenna of claim 1 wherein the RF amplifier is RF communicatively connected between the driven DUV element and the RF signal line, wherein the RF amplifier is selected from one of a low gain amplifier, a medium gain amplifier, a high gain amplifier, and a switch selectable gain amplifier, each amplifier having a signal gain between 6 dB and 30 dB.

3. The modular DUV antenna of claim 2 comprising a plurality of modular RF signal enhancers each RF communicatively connected to the driven DUV antenna comprising two DUV elements, and to the RF signal line.

4. The modular DUV antenna of claim 2 wherein the RF signal enhancer comprises an RF amplifier module diplexed to a satellite feed.

5. The modular DUV antenna of claim 2 wherein the RF signal enhancer comprises an extension RF amplifier module diplexed to the RF amplifier module.

6. The modular DUV antenna of claim 2 wherein the RF amplifier is RF connected between the driven DUV dipole and the signal line, wherein the signal line comprises a coax cable having a length between 1 m (3 ft) and 70 m (230 ft).

7. The modular DUV antenna of claim 2 wherein the RF amplifier is RF connected between the driven DUV dipole and the signal line, and wherein the signal line comprises a fiber optic line having a length between 1 m (3 ft) and 70 m (230 ft).

8. The modular DUV antenna of claim 1 wherein the RF booster is selected from: a small Urban booster, a medium Metro booster, and a large Fringe booster.

9. The modular DUV antenna of claim 8 wherein the small Urban booster has one reflective element above and/or below the antenna XY plane.

10. The modular DUV antenna of claim 1 comprising multiple driven DUV elements that form at least one driven DUV dipole, connected to the RF signal line, the DUV elements selected to form one of a UHF U-DUV dipole, a broadband UHF/VHF M-DUV dipole, a VHF V-DUV dipole, and an extended UHF/VHF X-DUV dipole wherein the driven DUV elements have a length between 102 mm (4 in) and 510 mm (20 in).

11. The modular DUV antenna of claim 1 wherein the modular RF director is selected from:

an Urban UHF director comprising one to three UHF director elements;

a Metro UHF director comprising four to nine UHF director elements;

a Fringe UHF director comprising ten to twenty UHF director elements;

a Metro RF director comprising a VHF director element and four to nine UHF director elements;

and a Fringe RF director comprising a VHF director element and ten to twenty UHF director elements.

12. The modular antenna of claim 11 wherein the UHF director elements have a width/length greater than 0.12.

13. The modular antenna of claim 1 wherein the passive RF enhancer comprises an RF reflector selected from an Urban reflector, a Metro RF reflector, and a Fringe RF reflector.

14. The modular antenna of claim 1 wherein the passive RF enhancer comprises a VHF reflector.

15. The modular antenna of claim 1 wherein the antenna mount comprises one of an interior standard mount, an interior elevation/polarization mount, and exterior standard mount, and an exterior elevation/polarization mount.

16. The modular antenna of claim 1 further comprising a modular signal junction RF connected to the RF signal line and selected from: a signal splitter, a signal distributor, and a signal multiplexer.

17. The modular antenna of claim 1 further comprising a container configured to contain one of a plurality of DUV antenna systems, configured from multiple DUV dipoles, RF amplifiers, RF directors, RF reflectors, and RF boosters.

18. The modular antenna of claim 1 further comprising a container configured to contain the driven DUV antenna and the RF signal enhancer and having an interior length less than or equal to 1054 mm (42.25 in) and an interior depth less than or equal to 171 mm (6.75 in).

19. The modular DUV antenna of claim 1 wherein the RF director is selected from five directors comprising a combination of one to twenty UHF director elements and zero to three UHF/VHF director elements mounted on one of five director booms having a length from 75 mm (3 in) to 3048 mm (120 in).

20. The modular antenna of claim 18 wherein the interior width of the container is less than or equal to 844 mm (33.25 in) and the VHF reflector has an electrical length greater than the container interior length.

21. The antenna system of claim 1 wherein the antenna mount comprises a support module selected from a base support module, a support module with amplifier, a dual support module with diplexed amplifiers, a diplexed support module having two external inputs and diplexed amplifiers, and a support module having a solar shield and an amplifier.

22. The support module of claim 21 having RF amplifiers configured to transmit and receive RF signals for two way RF communications.

23. The DUV elements of claim 3 are RF connected to the signal line through one of a direct connection, an RF amplifier, diplexed RF amplifiers, and a two way transmit/receive RF amplifier combination.

24. The antenna system of claim 1 further comprising a modular connector configured to connect the modular RF signal enhancer to the modular driven DUV antenna.

25. The antenna system of claim 1 wherein the RF director has a boom selected from one of five director booms having a length between 75 mm (3 in) and 3048 mm (120 in).

26. The antenna system of claim 1 wherein the off axis RF booster has a booster boom selected from a plurality of booster booms and has from one to six booster elements mounted on the booster boom.

27. The antenna system of claim 1 wherein the modular director connection and modular reflector connection are in common, wherein the RF director is connected to the RF reflector.

28. A modular antenna configuring method, the modular antenna; having an antenna support supporting a modular driven antenna pointing along a longitudinal X axis with a driven DUV element RF connected to an RF signal line, and supporting an RF enhancer, the RF enhancer comprising one of an RF amplifier connected to the driven DUV element, an RF director in front of the driven antenna, an RF reflector behind the driven antenna, an RF booster off of the longitudinal axis, the method comprising:

configuring the driven antenna and the RF signal line;

configuring a corresponding collection of RF enhancers with:

a plurality of RF directors having differing RF performance;

a plurality of RF reflectors having differing RF performance;

a plurality of RF boosters having differing RF performance; and a plurality of RF amplifiers having differing RF gain; and selecting the RF enhancer from among the plurality of RF directors, the plurality of RF reflectors, the plurality of RF boosters, and the plurality of RF amplifiers;

wherein the modular antenna has a prescribed UHF range performance and a prescribed VHF range performance.

29. The antenna configuring method of claim 28 further comprising configuring the UHF and VHF performance of the modular antenna to provide a wideband Gain/Mass ratio of the mean of the VHF High band gain and the UHF DTV band gain, divided by the mass of the DUV antenna, that is greater than 1.3 dB/kg.

30. The antenna configuring method of claim 28, further configuring one driven antenna module for three halves wave resonance in the UHF range between about 390 MHZ and 510 MHZ, and for five eighths wave resonance in the VHF range between about 163 MHZ and 213 MHZ.

31. The antenna configuring method of claim 28, comprising configuring one driven antenna module for three halves wave resonance in the UHF range between about 510 MHZ and 630 MHZ; and for one of one half wave resonance and five eighths wave resonance in the VHF between about 170 MHZ and 220 MHZ.

32. The antenna configuring method of claim 28, comprising configuring one driven antenna module for three halves wave resonance in the UHF range between about 630 MHZ and 810 MHZ; and for half wave resonance in the VHF range between about 210 MHZ and 270 MHZ.

33. The antenna configuring method of claim 28, further comprising selecting a driven antenna, a housing, an RF amplifier-gain, and the RF signal line option, and configuring and potting the selected components together in the housing.

34. The configuring method of claim 28 wherein the plurality of RF directors are configured to form a short UHF director, a medium UHF director, and a long UHF director.

35. The configuring method of claim 28 wherein the plurality of modular RF boosters is configured from boosters having from one to six RF booster elements.

36. The configuring method of claim 28 further comprising configuring a plurality of antenna mounts comprises a support module selected from a base support module, an amplified support module with the RF amplifier, and a diplexed support module with the RF amplifier and a second diplexed RF amplifier, the method further comprising selecting the antenna mount from the plurality of antenna mounts.

37. The configuring method of claim 28 wherein the plurality of amplifiers are configured with the RF gain ranging from 6 dB to 30 dB.

38. The configuring method of claim 28 wherein the plurality of RF reflectors are configured with one of a medium RF reflector and a long RF reflector, and are mounted on a longitudinal boom connected to the support module.

39. The configuring method of claim 28 wherein the antenna support comprises a support module connected to a longitudinal boom having a connection for the RF booster.

* * * * *